US010632487B2

(12) United States Patent
Greiner-Perth et al.

(10) Patent No.: US 10,632,487 B2
(45) Date of Patent: Apr. 28, 2020

(54) FLUID DISPENSER

(71) Applicant: APTAR RADOLFZELL GMBH, Radolfzell (DE)

(72) Inventors: Jürgen Greiner-Perth, Gottmadingen (DE); Dominik Brall, Moos (DE); Magnus Lutz, Uhldingen-Mühlhofen (DE); Karl Tempfli, Gottmadingen (DE)

(73) Assignee: Aptar Radolfzell GmbH, Radolfzell (DE)

( * ) Notice: Subject to any disclaimer, the term of this patent is extended or adjusted under 35 U.S.C. 154(b) by 0 days.

(21) Appl. No.: 16/095,086

(22) PCT Filed: May 3, 2017

(86) PCT No.: PCT/EP2017/060564
§ 371 (c)(1),
(2) Date: Oct. 19, 2018

(87) PCT Pub. No.: WO2017/191205
PCT Pub. Date: Nov. 9, 2017

(65) Prior Publication Data

US 2019/0111448 A1 Apr. 18, 2019

(30) Foreign Application Priority Data

May 4, 2016 (DE) ..... 10 2016 207 722

(51) Int. Cl.
*B05B 11/00* (2006.01)

(52) U.S. Cl.
CPC ..... *B05B 11/3059* (2013.01); *B05B 11/0027* (2013.01); *B05B 11/0032* (2013.01);
(Continued)

(58) Field of Classification Search
CPC ..... B05B 11/3059; B05B 11/0027; B05B 11/0032; B05B 11/3004; B05B 11/3015
See application file for complete search history.

(56) References Cited

U.S. PATENT DOCUMENTS 5,649,645 A 7/1997 Demarest et al.
6,708,846 B1 3/2004 Fuchs et al.
(Continued)

FOREIGN PATENT DOCUMENTS

DE 199 05 993 A1 8/2000
DE 10 2009 006 430 A1 7/2010
(Continued)

OTHER PUBLICATIONS

International Search Report issued in Application No. PCT/EP2017/060564 dated Aug. 9, 2017 and English translation (5 pages).
(Continued)

*Primary Examiner* — Jeremy Carroll
(74) *Attorney, Agent, or Firm* — Flynn Thiel, P.C.

(57) ABSTRACT

A dispenser includes a housing and a discharge opening provided at the distal end of the housing. The dispenser includes a liquid reservoir and a control device having a pump or a switching valve, which control device is connected by a first line to the liquid reservoir and by a second line to the discharge opening, and via which control device liquid is conducted from the liquid reservoir to the discharge opening. The dispenser includes a push button provided laterally in a cutout of a circumferential face of the housing and connected to the control device such that pressing the push button actuates the control device so that liquid is conducted to the discharge opening. Measures for securing the dispenser include a rotatable sleeve over the push button, a secured cap, a securing arrangement on the push button, an
(Continued)

interaction of the push button with an opposite side of the dispenser, and a receiving sleeve for the dispenser.

25 Claims, 18 Drawing Sheets

(52) U.S. Cl.
CPC ..... *B05B 11/3004* (2013.01); *B05B 11/306* (2013.01); *B05B 11/3015* (2013.01); *B05B 11/3064* (2013.01)

(56) References Cited

U.S. PATENT DOCUMENTS

2002/0134798 A1* 9/2002 Lamboux ..... B05B 11/3009 222/251
2008/0118299 A1* 5/2008 Py ..... B65D 47/18
2009/0236374 A1* 9/2009 Pardes ..... A61F 9/0008 222/494
2010/0187260 A1 7/2010 Stadelhofer et al.
2013/0306683 A1 11/2013 Wochele et al.
2016/0144395 A1* 5/2016 Brugger ..... A45D 40/262 401/150

FOREIGN PATENT DOCUMENTS

EP 2 210 674 A2 7/2010
JP 2002-104552 A 4/2002
WO WO 2008/061041 A2 5/2008
WO WO 2012/084354 A2 6/2012

OTHER PUBLICATIONS

Written Opinion issued in Application No. PCT/EP2017/060564 dated Aug. 9, 2017 (5 pages).

* cited by examiner

FLUID DISPENSER

FIELD OF USE AND PRIOR ART

The invention relates to a dispenser for discharging pharmaceutical liquids in accordance with the preamble of claim 1.

Dispensers according to the generic type and according to the invention comprise an elongate housing which is oriented along a center axis. A discharge opening which is oriented axially in the direction of the center axis is provided at the distal end of the housing, through which discharge opening liquid can be output to the surroundings, for example as droplets and a spray jet. Furthermore, a dispenser of this type comprises a liquid reservoir and a control device having a pump or a switching valve, which control device is connected by way of a first line to the liquid reservoir and by way of a second line to the discharge opening, and by means of which control device liquid can be conducted out of the liquid reservoir to the discharge opening. For the purpose of actuation, the dispenser comprises a push button which is provided laterally in a cutout of a circumferential face of the housing and which is connected to the control device in such a way that radial pressing in of the push button in the direction of the center axis actuates the control device, with the result that liquid is conducted to the discharge opening.

Dispensers of this type which are according to the generic type and represent the starting point of the invention are also called side actuation dispensers.

The special characteristic of said dispensers according to the generic type and according to the invention lies in the fact that the actuation takes place laterally. For this purpose, the housing which is substantially rotationally symmetrical or cylindrical at least in the region of the circumferential face has the abovementioned push button which can be pressed in the radial direction or with a predominant radial component in the direction of the center axis, in order to conduct liquid in the direction of the discharge opening as a result. This can happen by way of the fact that the push button moves the plunger of the plunger pump or compressed the bellows of a bellow pump or else opens a valve, with the result that liquid which was already previously pressurized can flow in the direction of the discharge opening.

Designs which represent a securing means of the dispenser against utilization by children are already known from the field of further pharmaceutical dispensers, the actuating direction of which coincides with the discharge direction. This prevents children, in particular infants, from discharging and receiving the pharmaceutical liquid.

Problem and Solution

It is a problem of the invention to provide a side actuation dispenser according to the generic type with an effective and structurally simple child safety means.

Five variants are proposed for this purpose.

The following is proposed in accordance with a first variant of the invention: the dispenser comprises a rotating sleeve or sliding sleeve which is open on both sides and is attached on the outer side of the housing such that it can be rotated or displaced about the center axis. In a locking rotating position or a locking sliding position, said sleeve prevents the actuation of the push button and, in a release rotating position or a release sliding position, the sleeve permits the push button to be pressed in radially.

In accordance with said design, a sleeve is therefore provided which completely or almost completely (>270°) surrounds the housing of the dispenser at least in the region of the push button and, in the case of a rotating sleeve, although it can be rotated as intended about the center axis with respect to the circumferential face of the housing, it cannot be removed or does not have to be removed at least for the purpose of the actuation. Said rotating sleeve is preferably secured on the housing in the axial direction, with the result that it can be moved exclusively rotationally. The sliding sleeve which is proposed as an alternative can be moved to a limited extent in the axial direction with respect to the housing. It can be of non-rotatable configuration or can be designed such that it can be displaced and rotated with respect to the housing.

The rotating sleeve or the sliding sleeve is open on the end side at both ends in the manner of a tube, with the result that it can be pushed onto the housing, in particular, from the side of the discharge opening. Here, it is pushed on to such an extent that the distal end of the housing and the discharge opening which is provided there protrude beyond the rotating sleeve or the sliding sleeve in the axial direction in the pushed-on state, that is to say protrude beyond the distal side end of the rotating sleeve or sliding sleeve.

The push button can be pressed or pressing is prevented and/or blocking in a manner which is dependent on the rotating position of the rotating sleeve or the sliding position of the sliding sleeve. The actuation is not possible in the locking rotating position or the locking sliding position, either because the push button is not accessible or because its movement is blocking mechanically. In the release rotating position or release sliding position, the push button is accessible and can be moved radially for the purpose of the liquid discharge, with the result that the valve which is coupled to it is opened or the pump which is connected to it is actuated.

The sleeve itself is open on both sides and therefore does not represent a cap which covers the discharge opening. However, a dispenser of this type can additionally have a cap which can be fastened to the housing or the rotating sleeve and/or can cover the housing and the sleeve in the fitted state.

The sleeve can have an actuating cutout which, in the release position, is arranged on the outer side of the push button and ensures the access to the push button.

In the case of a design of this type of the sleeve with an actuating cutout, the sleeve can be moved between a position (locking rotating position or locking sliding position), in which the actuating cutout is not arranged above the push button and the latter is instead concealed, and a position (release rotating position or release sliding position), in which the cutout allows the access to the push button. The sleeve is preferably a component which runs around the housing and is either of slimmer design in relation to the axial direction in the region of the actuating cutout or has a cutout which is enclosed by the sleeve and through which the push button is accessible in the release position of the sleeve. An interruption of the rotating sleeve in the region of the actuating cutout is also possible.

It can fundamentally be sufficient to produce the child safety means solely by virtue of the fact that the sleeve is moved into its locking position after use. It is advantageous, however, if an additional safety means in said locking position prevents the sleeve from being rotated or displaced directly. Said additional securing means can consist, in particular, in that a housing-side section or the sleeve itself has to be deflected or deformed elastically, in order to produce the rotatability or displaceability.

For this purpose, a locking pawl which can be deflected radially toward the center axis can be provided on the housing, by means of which locking pawl the sleeve can be locked in at least one locking position, with the result that it requires a deflection of the locking pawl, in order to rotate or to slide the sleeve into the release position. An additional obstacle for children is produced by way of a locking pawl of this type. In order to move the sleeve into its release position, first of all the preferably spring-loaded locking pawl has to be deflected, with the result that it then permits the rotating or sliding of the sleeve. The locking pawl can be formed, in particular, by way of a section of the circumferential face of the housing, which section has to be pressed radially toward the inside for the purpose of the movement of the sleeve. This is a very simple method in terms of manufacturing technology. The locking pawl is already provided in its blocking position during the manufacture of the plastic component which forms the circumferential face in the mounted state, with the result that said spring loading during operation results from the fact that the locking pawl is pressed radially toward the inside for the purpose of the movement of the sleeve and the plastic component is deformed elastically as a result.

In the locking state, the locking pawl interacts with the sleeve in a non-positive or, in particular, positively locking manner, in order to make a movement of the sleeve more difficult or to prevent it. In the case of a positively locking design, the locking pawl engages into a depression, aperture or the like on the sleeve in the secured state.

The locking pawl can be arranged on the housing in such a way that it protrudes into the actuating cutout in the locking position.

In the case of a design of this type, the actuating cutout therefore fulfills two purposes: firstly, it makes it possible for the push button to be pressed down in the release position of the sleeve. Secondly, it blocks a movement of the sleeve together with the locking pawl in the locking position.

The locking pawl can be connected fixedly to the push button and, in the locking position, can protrude into a locking cutout which is separate from the actuating cutout in the sleeve, which locking cutout is arranged offset circumferentially or in the axial direction with respect to the actuating cutout.

In the case of said alternative design, a section on the push button itself forms the locking pawl and, in the locking position of the sleeve, engages into a second locking cutout which is separate from the actuating cutout. For release, the push button or the locking pawl which is provided on it therefore has to be pressed in radially somewhat. Only then can the sleeve be rotated or displaced, in order that an actuation is subsequently possible. In addition to a design, in the case of which the locking pawl can be connected fixedly to the push button, it is also conceivable that, although the locking pawl is provided on the push button, an elastic compensation element is provided between the locking pawl and the surrounding parts of the push button, with the result that the movement of the locking pawl does not yet also displace the predominant part of the push button, with the result that no discharge yet takes place during unlocking of the sleeve.

The sleeve can have a cutout, into which the locking pawl protrudes in the secured state. In the case of a refinement of this type, it can have a projection which is shaped in such a way that it can be introduced into the cutout after removal of the cap from the housing or the sleeve, in such a way that, as a result, the locking pawl can be deflected and subsequently the sleeve can be moved into the release position.

In the case of a design of this type, a type of key/lock system is provided. The removable cap has a projection, for example in the manner of a slim pin, which can be pushed into a corresponding cutout of the sleeve, in order to deflect the locking pawl. Said recess has a size and/or shape which do/does not make it possible to deflect the locking pawl, at least without a tool, that is to say solely by way of the fingers of a child.

In the case of the abovementioned designs, it is provided that, in particular, a housing-side locking pawl can be moved. As an alternative to this, the following can be provided:

The sleeve and the housing can be provided with rotating or translation locking faces which interacts in a positively locking manner and, in the locking position, prevent the movement of the sleeve with respect to the housing. In the case of a refinement of this type, the sleeve can be manufactured from an elastically deformable plastic which permits a deformation, in particular an oval deformation, of the sleeve by way of external force loading, by way of which deformation the locking faces can be brought out of engagement, with the result that a movement of the sleeve into the release position is subsequently possible.

In the case of a design of this type, the sleeve and the housing are adapted to one another in such a way that, at least in the locking position, there is a positively locking prevention of a rotation or a sliding movement. The sleeve which preferably encloses the housing completely in this case first of all has to be deformed, in particular has to be deformed in a slightly oval-shaped manner by way of a two-sided force loading, in order that the engagement between the locking faces on the housing and the sleeve is ended. The sleeve can subsequently be moved. In the case of one special design, it is also provided in the release position that it is secured by way of the locking faces. Designs are advantageous, in particular, in the case of which the locking faces are formed on radial depressions or elevations on the housing side and the sleeve side.

The following is proposed in accordance with a second variant of the invention: the dispenser comprises a detachable cap which, in the fitted state, covers the discharge opening and can be detached from the housing in the direction of the center axis toward the distal end and the discharge opening. The cap and the housing have interacting fixing elements which, in a relative engagement position, prevent the cap from being detached from the housing, and can be moved by way of deformation of the cap and/or rotation of the cap about the center axis and/or a relative movement of a housing section of the housing, on which housing section the fixing element is provided, with respect to the circumferential face of the housing, into a relative release position, in which they do not counteract the detaching of the cap.

In the case of a design of this type, it is accordingly provided that the discharge opening and preferably also the circumferential face with the push button are covered by a removable cap which prevents the discharge of liquid and preferably also the actuation of the push button. Said cap is provided for being detached in the axial direction in the direction of the distal end of the housing, but also cannot be detached without prior unlocking.

The cap and the housing can be provided with fixing elements which interact in a positively locking manner in the form of translation locking faces which, in the case of a fitted cap, prevent the cap from being detached axially from the housing.

In at least one rotating position of the cap with respect to the housing, there can be a sufficient spacing between a cap inner side the the housing in a deformation region of the cap in the case of said refinement, with the result that the cap can be deformed by way of radial force loading in such a way that the translation locking faces can be brought out of engagement, with the result that a removal of the cap is subsequently possible.

Said first subvariant of the second variant of the invention provides that the cap is deformed in a deformation region, in particular is loaded with force on both sides, in order to change the cross-section of the cap in said deformation region, the translation locking faces which previously counteract removal being brought out of engagement with one another as a result. For this purpose, the cap and the housing have to be adapted to one another in such a way that a sufficient deformation of the cap, in particular offset by 90° with respect to the cap-side translation locking face, is possible in said rotating position.

It is preferred if, in at least one rotating position of the cap with respect to the housing, there is not a sufficient spacing from the housing in a deformation region of the cap, with the result that the cap cannot be deformed by way of radial force loading sufficiently for the translation locking faces to be brought out of engagement.

Said development provides that the cap cannot be deformed in the deformation region in every rotating position to such an extent that the translation locking faces can be brought out of engagement. This is not possible in at least one rotating position, with the result that the detaching of the cap is made more difficult for a child. Starting from a relative position between the cap and the housing in said second rotating position, the cap has to first of all be rotated about the center axis with respect to the housing, in order only then to subsequently permit a sufficient deformation.

Building on this, in particular, it can be provided that the cap and the housing are provided with interacting rotating locking faces which, in the case of a fitted cap, prevent a rotation of the cap by the housing, the cap and the housing being configured in such a way that the rotation locking faces can be brought out of engagement with one another by way of radial force loading of the cap.

In the case of a design of this type, detaching of the cap is therefore not only prevented in a defined rotating position, it preferably not being directly possible, in particular, for the detaching to also be made possible by way of pronounced deformation of the cap, but rather free rotation of the cap is also not possible if the rotation locking faces have not previously been brought out of engagement with one another by way of deformation of the cap.

The rotating position which has a limiting action in this way is preferably defined by way of two cap-side rotation locking faces which are arranged offset with respect to one another in the circumferential direction. In this case, a receiving region is provided in the intermediate region between said-capside rotation locking faces, which receiving region is provided for receiving a housing-side cam. The housing-side cam can be moved out of said receiving region only by way of a rotating movement, said deformation of the cap being required for this purpose. However, the cap preferably cannot be deformed to a sufficiently pronounced extent by way of radial force loading, such that the housing-side cam might be pulled axially directly out of the receiving space, since the translation locking faces which are preferably larger in radial terms with respect to the rotation locking faces counteract this.

Instead of said design with a housing-side cam and two cap-side rotation locking faces which enclose said cam, a reversal is also possible, in the case of which the cam is provided on the cap side and is fixed rotationally by way of two rotation locking faces on the housing which are spaced apart from one another, until the rotation locking faces can be overcome by way of deformation of the cap.

At least one rotation locking face is preferably assigned an oblique face which is tilted with respect to the tangential direction and by means of which the cap can overcome the housing-side rotation locking face unidirectionally without radial force loading. Said bevel therefore allows the cap to rotate with respect to the housing in one direction, without having to be deformed in a targeted manner for this purpose. This facilitates the movement of the abovementioned cam into the region of the recess between the rotation locking faces. Both a design, in the case of which only one of the two rotation locking faces which delimit the recess is assigned a bevel of this type, with the result that the cam can engage into the recess in a manner which is facilitated only in one rotational direction, and a design with in each case one bevel of this type for each of the two rotation locking faces, with the result that an introduction of the cam into the recess is possible here in both rotational directions, are possible. At least one latching lug can be provided as a cap-side fixing element on the cap, which latching lug interacts with a housing-side latching edge as a housing-side fixing element in the relative engagement position. In said refinement, the cap-side latching lug can be capable of being deflected radially to the outside, in order to be brought out of engagement with the latching edge and therefore into the relative release position.

In the case of said subvariant, a latching lug is provided as a cap-side fixing element which interacts with a housing-side latching edge and, as a result, first of all prevents the detaching of the cap. By way of deflection toward the outside, the latching lug can be brought out of engagement with the latching edge, it being preferred in the case of said second subvariant that the cap-side latching lug is deflected in an isolated manner, without the entire cap cross section being deformed.

A holding lug can be provided as a fixing element on the cap. In the case of said refinement, the housing can have a bayonet ring with a slotted guide which extends in the circumferential direction, the slotted guide being sufficiently large in a slide-in region to permit sliding in of the cap-side holding lug, and being provided in a holding section with a tapering section which is provided as a fixing element, with the result that the holding lug, in the case of an arrangement in said holding section, cannot be pulled axially out of the slotted guide. In the case of a fitted cap, the bayonet ring and the cap can be rotated with respect to one another about the center axis.

In the case of said further subvariant of the second variant of the invention, the cap with cap-side holding lugs interacts with a bayonet ring, the shape thereof not being important, but rather the slotted guides being important which are provided thereon, extend in the circumferential direction, and into which the holding lugs can be pushed axially. In the slide-in region of the slotted guides, the holding lugs can be pushed in, possibly in a shape which is curved slightly toward the center axis. If, however, the cap and the bayonet ring are rotated about the center axis with respect to one another in the case of holding lugs which have been pushed in, the holding lugs are situated in that holding section of the slotted guide, in which they are secured against being pulled out axially by way of a bayonet ring-side web or the like which forms the tapering section.

It has been shown that a bayonet connection of this type is difficult for children to open. This is true, in particular, if both the bayonet ring and the cap can be rotated with respect to the circumferential face of the housing. In this case, said child already requires both hands for the relative rotation and for the possibility of being able to load in each case the bayonet ring and the cap with torque by way of both hands. This is not possible with small child hands.

The bayonet ring can additionally have a cutout, into which the holding lug of the cap can engage radially if the holding lug is situated in the holding section of the slotted guide, with the result that a relative rotation of the cap with respect to the bayonet ring is possible only after an opposite radial movement of the holding lug out of the cutout. Said additional cutouts lead to the holding lugs being secured in the holding section of the slotted guide against a rotary relative rotation with respect to the slotted guide. In particular, said cutouts can extend radially to the outside from the slotted guide. In the case of a design of this type, the holding lugs are pushed into the slotted guides in a slightly prestressed state. In the case of rotation of the bayonet ring with respect to the cap, they pass into the holding section and once again spring lightly radially outward when said cutouts are reached.

In order to release a connection of this type, the holding lugs of the cap first of all have to be pressed radially inward, in order first of all to permit a rotation and then an axial detachment of the cap with respect to the bayonet ring or from the housing.

In accordance with a third variant of the invention, the following is proposed: the push button and the housing are provided with interacting fixing elements which permit the radially acting fixing of the push button with respect to the housing in a fixing position.

In the case of said design of the invention, the child safety means is not achieved or is not only achieved by virtue of the fact that the discharge opening and the push button are not accessible to the child, but rather by way of the immovability of the push button which is provided for the radial movement with respect to the housing.

A child therefore first of all has to comprehend how it can release said fixing, in order to bring about a discharge.

The fixing elements can be configured for fixing the push button in the pressed-in state. The fixing in the pressed-in-state makes it more difficult to overcome the fixing by way of force. It is more difficult to forcibly pull out an actuating button which is recessed in the cutout of the circumferential face than to press it in.

The fixing elements can be configured for automatically latching in, with the result that a movement of the push button radially to the outside or radially to the inside brings about fixing of the push button.

The automatic latching brings it about that this type of securing means is not forgotten. Therefore, not only is a discharge preferably brought about by way of the push button being pressed down, but rather the secured state is also produced at the same time. It can be provided in the case of one special refinement that a pressure point has to be overcome before the automatic latching, with the result that a partial stroke for discharging and a full stroke for discharging and fixing the push button can be differentiated in a haptic manner.

One of the fixing elements, in particular that one on the push button, can be capable of being moved transversely with respect to the radial direction in order to produce and to release the fixing position. In the case of said refinement, the fixing element can be provided, in particular, on a tilting element which has a release face for manual force loading, by means of which release face the tilting element can be moved, with the result that said fixing element can be brought out of engagement with the other fixing element, in particular that one on the housing side, as a result.

The movable fixing element can therefore be moved transversely with respect to the radial direction with respect to the actuating face of the push button, for example parallel to the axial direction of the center axis. The design having said tilting element which has both the fixing element and the release face is advantageous. A tilting element of this type allows the force loading direction for release purposes to result in an opposite movement of the fixing element which then releases the fixed state.

It is provided in the case of one subvariant of said third variant that one of the fixing elements is configured in the manner of a slide which can be displaced with respect to the housing between the fixing position and a release position. Said slide and the push button are configured for interacting in a positively locking manner in the fixing position, a depression or aperture, in particular, being provided on the push button for this purpose, into which depression or aperture the slide engages in its fixing position and out of which depression or aperture the slide is pulled in its release position.

In the case of a design of this type, two elements which can be moved with respect to the housing by way of the user are therefore provided, namely firstly the push button and secondly said slide, different apertures preferably being provided in the housing for handling the two elements. The slide can be moved independently of the push button and, in an end position, prevents the movement, in particular the pressing in, of the push button.

A child therefore first of all has to move the slide, in order subsequently for it to be possible to discharge liquid by way of the push button being pressed in. The safety preventing this can be increased by way of a slide which is stiff in a targeted manner. Furthermore, the shape of the slide, the housing and/or the push button can be configured in such a way that the slide can be displaced only after it has been pressed in with respect to the housing, or that the push button has to be pressed in slightly in order for it then first of all to be possible for it to be brought out of engagement with the push button.

The displacement movement of the slide for blocking and releasing the push button is preferably oriented in a linear manner. There are also other possibilities, however, such as the movement of the slide along a circular track. The following is proposed in accordance with a fourth variant of the invention: the housing has at least one aperture in a manner which lies opposite that cutout of the circumferential face, in which the push button is arranged. The push button is coupled to at least one projection which, in the case of the push button being pressed in, is pushed through the aperture out of the housing, or at least one locking part which can be detached from the housing or can be moved with respect to the housing is provided, which locking part, in a locking position, protrudes by means of a projection through the aperture into the housing and prevents the push button being pressed down.

It is provided in the case of said variant that the movability of the push button is influenced by way of an aperture which lies circumferentially opposite the cutout of the circumferential face. The push button can thus be provided with a projection which can also be an integral part of the push button and which is pressed through the aperture toward the outside during pressing down of the push button on the opposite side. This leads to a child who produces a counterforce with the second-hand on said opposite side not being capable of pressing down the push button. In contrast, an adult might grip the dispenser in a targeted manner such that he/she does not cover the apertures and therefore does not prevent the exit of the projection.

As an alternative, said locking part can also be provided which protrudes through the apertures into the interior of the housing and prevents the movement of the push button there. Pressing down is then possible only after detaching or movement of the locking part.

Mixed designs are also possible, for example a locking part which covers the apertures, without engaging into them by means of projections. The projections which are then provided on the push button cannot exit on account of said locking part and thus prevent an actuation.

Said locking part can serve solely for the purpose of blocking. However, it might also at the same time be a cap which at least partially covers the discharge opening.

The locking part can be configured as a removable locking part and can be adapted to the housing in such a way that it can be fastened to the housing in a radial direction.

The locking part can have a shell shape which is adapted to the outer contour of the housing, engages around the housing over an angle of more than 180° in the fastened state, and has an inner side, on which at least one projection is provided. A locking part of this type can be fitted radially from the side or can be pushed on axially. By virtue of the fact that it engages around the housing with an angle of >180°, it is fixed on the latter and preferably forms a clamping connection with it.

The following is proposed in accordance with a fourth variant of the invention: the dispenser comprises a receiving sleeve, the inner volume of which is adapted to the outer shape of the housing in such a way that the housing including the liquid reservoir can be received completely therein. The inner wall of the receiving sleeve and the outer faces of the housing are adapted to one another in such a way that they counteract the housing being pulled out in a non-positive manner. The receiving sleeve has a lateral cutout, through which the housing can be pushed in the direction of an open end of the receiving sleeve counter to the non-positive connection. Designs having a plurality of lateral cutouts of this type in a circumferential face of the receiving sleeve are also conceivable.

In the case of said fourth variant of the invention, the child safety means is produced by virtue of the fact that the dispenser is received as an entirety into said receiving sleeve, with the result that it does not provide any parts which protrude out of the receiving sleeve and allow it to be pulled out. Instead, the housing has to be loaded with force through the lateral cutout, in order to push it out at the open end of the receiving sleeve. It has been shown that comprehending this and overcoming the non-positive connection is difficult to master for children.

The receiving sleeve and the housing can be adapted to one another in such a way that pushing in of the housing is possible only in a rotational position, in which the push button and the cutout are offset in the circumferential direction with respect to one another. As an alternative, the receiving sleeve and the housing can be adapted to one another in such a way that pushing in of the housing is possible only in a rotational position, in which the push button and the cutout are arranged so as to coincide in the circumferential direction.

In the case of a design, in which pushing in is possible only when the push button and the cutout are offset in the circumferential direction with respect to one another, the risk that the push button is actuated during pushing of the housing out of the receiving sleeve is reduced.

The opposite design can also be advantageous, however, since it requires greater dexterity to bring about pushing out of the housing, although the push button is accessible and can be pressed down through the cutout.

BRIEF DESCRIPTION OF THE DRAWINGS

Further advantages and aspects of the invention result from the claims and from the following description of preferred exemplary embodiments of the invention which are described in the following text using the figures.

DETAILED DESCRIPTION OF THE EXEMPLARY EMBODIMENTS

Figure 1:
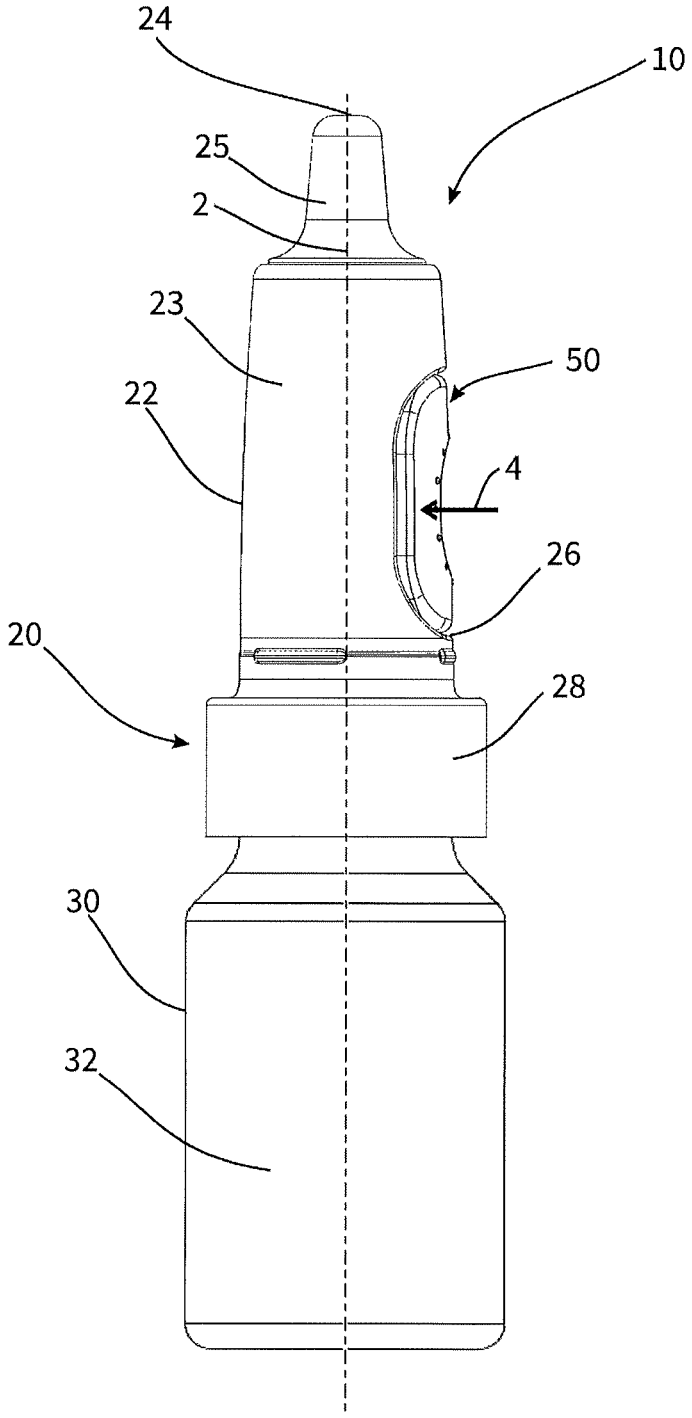
FIG. 1 shows a dispenser according to the generic type having a lateral push button which is used in the case of all exemplary embodiments in a similar design.

FIG. 1 shows what is known as a side actuation dispenser 10. The latter has a housing 20 with a discharge assembly 22 and a reservoir 30 which is coupled in the region of a coupling ring 28 of the discharge assembly 22 and comprises a liquid reservoir 32.

At the distal end, the discharge assembly 22 has a discharge opening 24 at the end of an applicator tip 25 which is designed as a nasal olive, and an approximately cylindrical and largely rotationally symmetrical circumferential face 23 between the nasal olive and the coupling ring 28. A cutout 26 is provided in the region of said circumferential face 23 which is gripped by the user for the purpose of handling the dispenser 10, in which cutout 26 a push button 50 is arranged. Said push button 50 can be pressed in in the direction of the arrow 4, said direction enclosing approximately a right angle with the center axis 2 of the dispenser, which center axis 2 coincides with the discharge direction at the discharge opening 24.

It is a subject matter of the invention to provide a child safety means for a dispenser of the type from FIG. 1.

Figure 2:
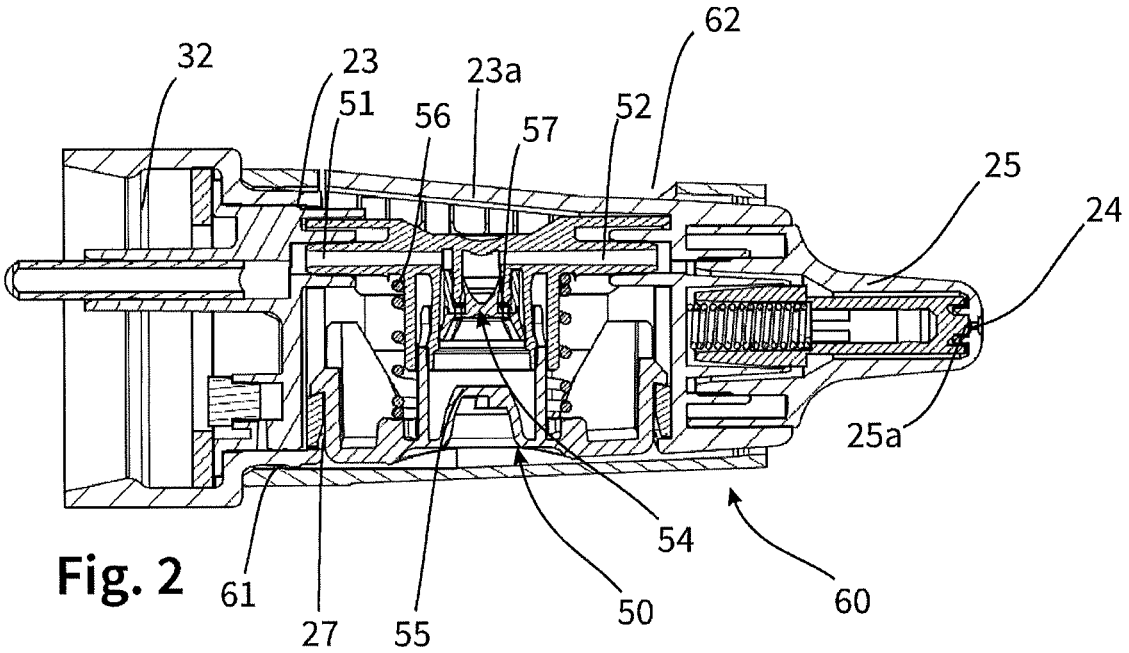
FIGS. 2 to 5 show one exemplary embodiment of a dispenser according to the invention in accordance with the first variant of the invention having a rotating sleeve which is secured via a deflectable locking pawl.
Figure 3:
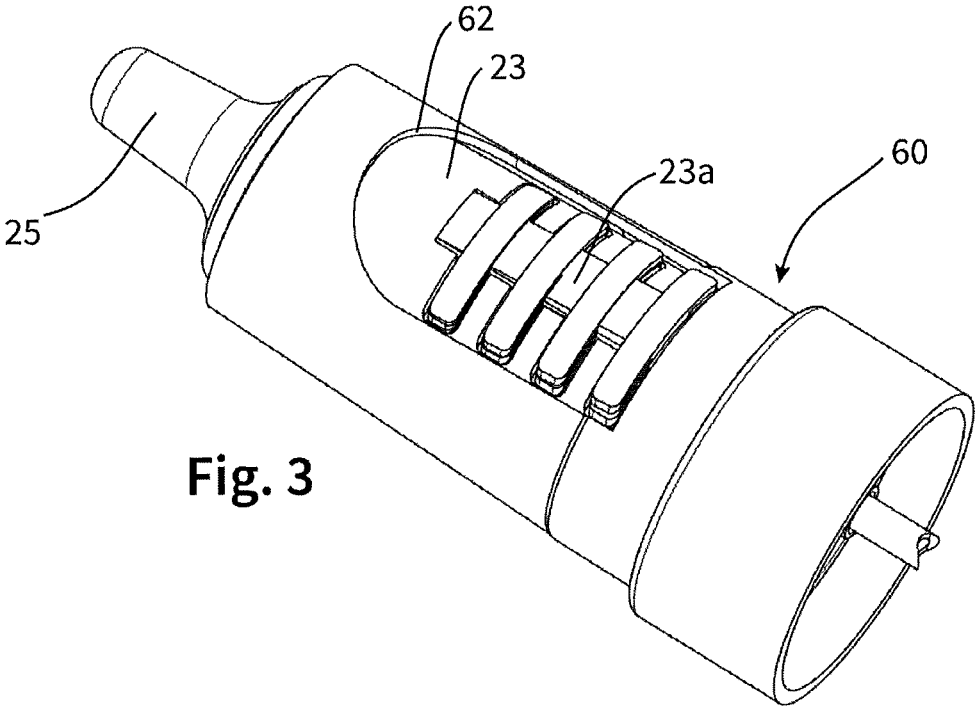
Figure 4:
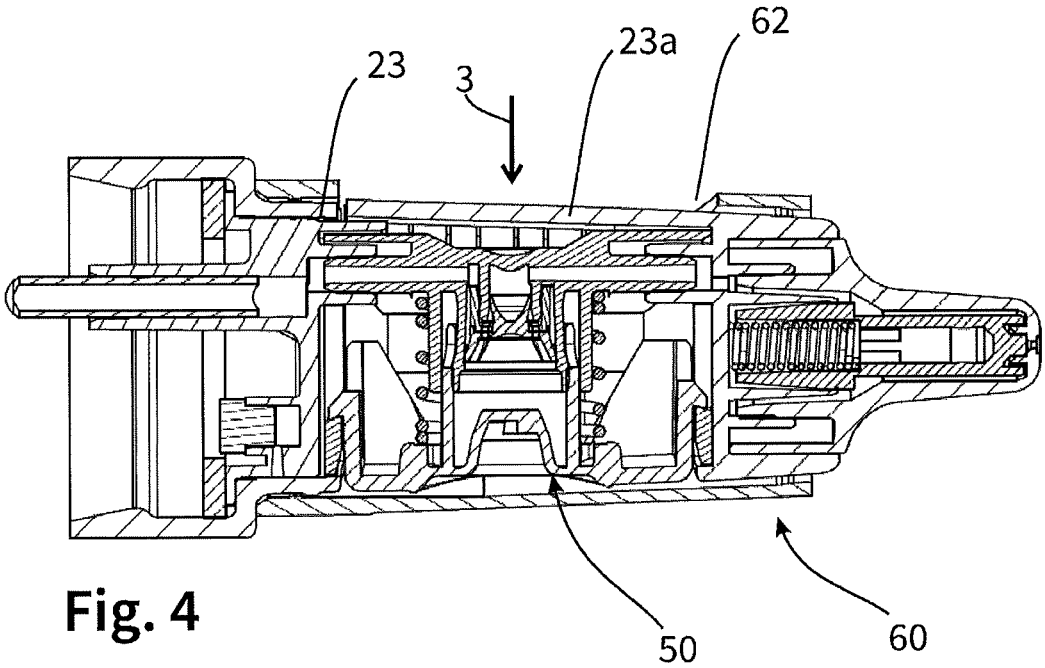

The inner components in the region of the discharge assembly 22 are to be described by way of example using FIG. 2, but are identical for all exemplary embodiments. The liquid reservoir 32 is connected via a line 51 to a pump 54. Said pump 54 has a movable cylinder 55 which can be pressed in together with the push button 50. Furthermore, the pump 54 has a valve arrangement 57 (not described in greater detail) which draws in liquid through the line 51 in the case of vacuum in the pump cylinder 55 and presses liquid in the direction of a second line 52 in the case of positive pressure in the pump cylinder 55, which second line 52 for its part leads to the discharge opening 24 with an outlet valve 25*a* connected in between.

Figure 5:
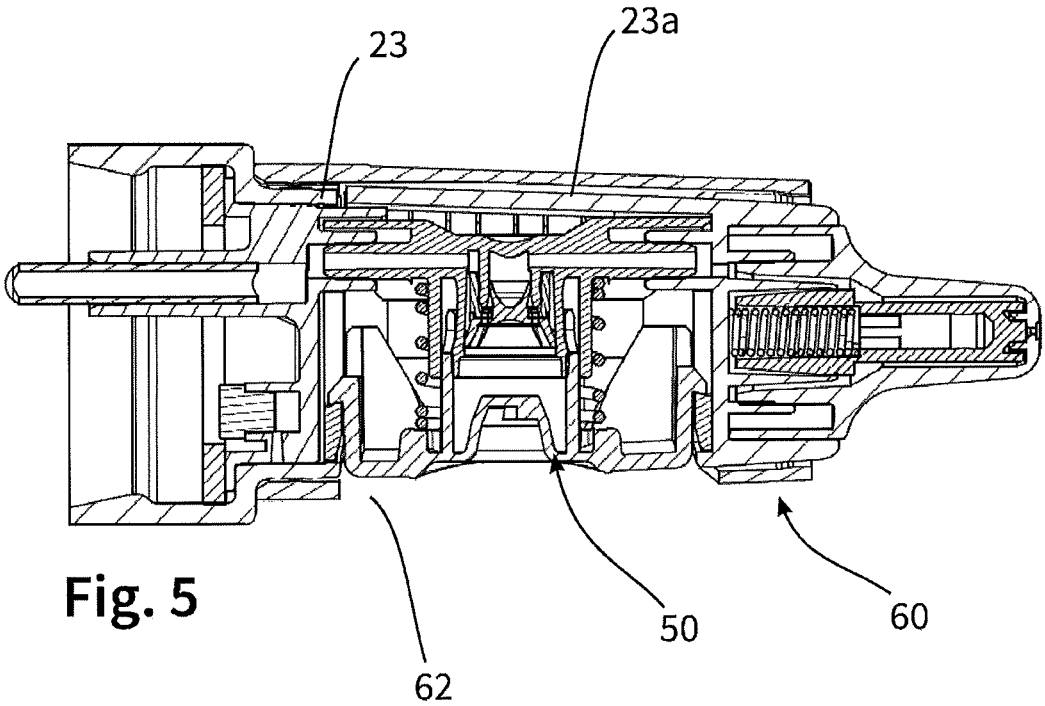

The first refinement of FIGS. 2 to 5 for producing a child safety means has a rotating sleeve 60 which is attached on the outer side on the circumferential face 23 of the housing 20. A latching means 61 ensures that said rotating sleeve 60 is only rotationally movable, but cannot be detached readily from the housing 20. The rotating sleeve 60 has an actuating cutout 62 which has approximately the size of the outer side of the push button 50. In the locked position of FIG. 2 and FIG. 3, said actuating cutout 62 is offset by 180° with respect to the push button 50, with the result that the push button 50 is covered by the rotating sleeve 60 and is not accessible. A rotation of the rotating sleeve 60 is not directly possible, since the circumferential face 23 of the housing 20 is provided in the way which can be seen, in particular, from FIG. 2 with a bulge which acts as a locking pawl 23*a* and protrudes into the actuating cutout 62. If the dispenser 10 is to be actuated from this state, first of all the locking pawl 23*a* has to be pressed in radially to the inside in the way which is illustrated by way of arrow 3 in FIG. 4. Only then can the rotating sleeve 60 be rotated by 180°, with the result that the state of FIG. 5 is set, in which state the actuating cutout 62 of the rotating sleeve 60 allows access to the push button 50. Proceeding from said state, the dispenser can then be utilized as intended. Subsequently, the actuating sleeve 60 is rotated again by 180°, with the result that the locking pawl 23*a* which is held under stress during the actuation jumps into the actuating cutout 62 again.

Figure 6:
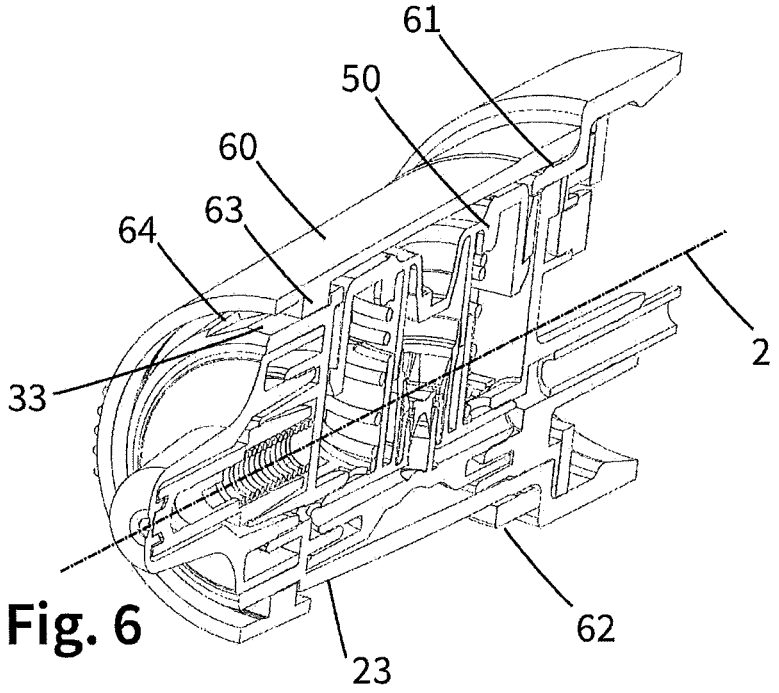
FIGS. 6 to 7 show one exemplary embodiment of a dispenser according to the invention in accordance with the first variant of the invention having a rotating sleeve which is secured via rotation locking faces.
Figure 7:
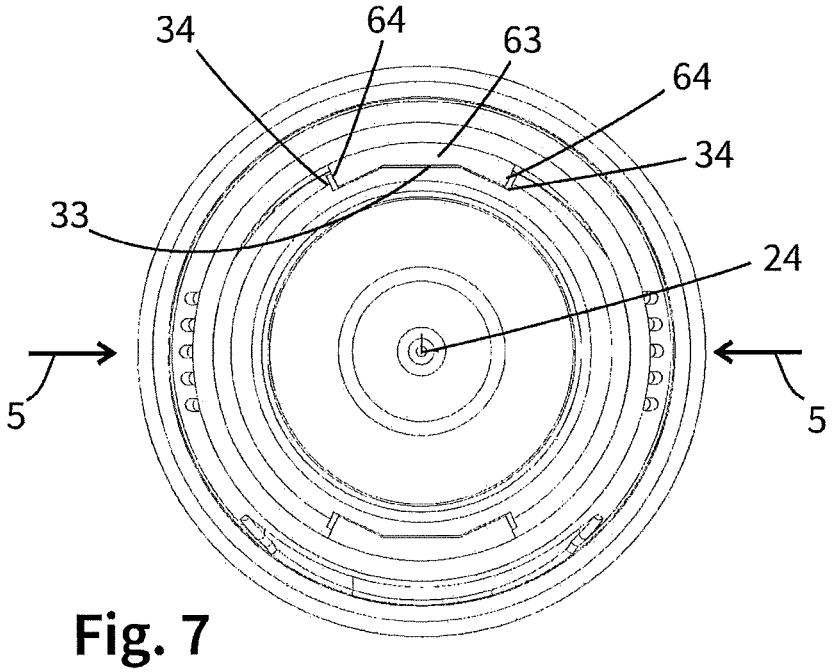

In the case of the exemplary embodiment according to FIGS. 6 and 7, a rotatable rotating sleeve 60 is likewise provided which can be rotated about the center axis 2 with respect to a circumferential face 23 and a push button 50. Said rotating sleeve 60 can also be moved into a rotation position, in which the actuation cutout 62 is not arranged above the push button 50 and therefore prevents an actuation in this way.

In a deviation from the design of FIGS. 2 to 5, the anti-rotation safeguard is realized differently here, however. Blocking webs 62 are provided offset by 180° with respect to one another on the inner side of the rotating sleeve 60. In a manner which corresponds thereto, depressions 33 are provided in the circumferential face 23 of the housing 20. Both the blocking webs 63 and the depressions 33 are delimited laterally in the circumferential direction in each case by way of rotation blocking faces 34, 64. A rotation of the rotating sleeve 60 is therefore not possible in the secured state of FIG. 7. However, the rotating sleeve 60 is manufactured here from a sufficiently deformable plastic, with the result that force loading in the direction of the arrow 5 is suitable, in order to lift the blocking webs 62 which are offset by 90° with respect to this out of the respective depressions 33. Subsequently, the desired rotation of the rotating sleeve 60 with respect to the circumferential face 23 can take place, and therefore the actuating cutout 62 can be moved into a rotation position, in which it permits the actuation of the push button 50.

In the case of the exemplary embodiment which is shown, an anti-rotation safeguard is effected by the blocking webs 63 and the depressions 33 both in that position of the rotating sleeve, in which it covers the push button 50, and also in that rotation position, in which the actuation is possible through the actuating cutout 62.

In the case of a simplified alternative design, however, only one depression 33 and only one blocking web 63 are provided, with the result that only that rotation position is blocked by way of said elements, in which rotation position the push button 50 is not accessible.

Figure 8:
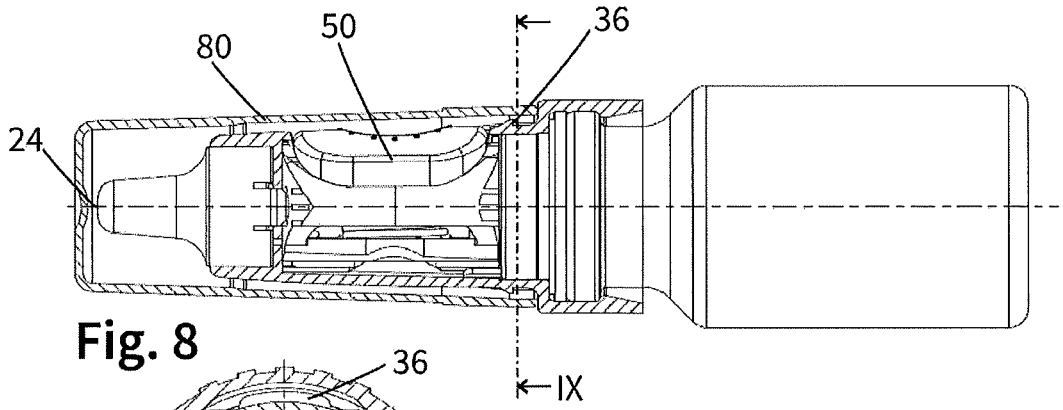
FIGS. 8 to 11 show one exemplary embodiment of a dispenser according to the invention in accordance with the second variant of the invention having a cap which can be released by way of deformation in a manner which is dependent on its rotational position.
Figure 9:
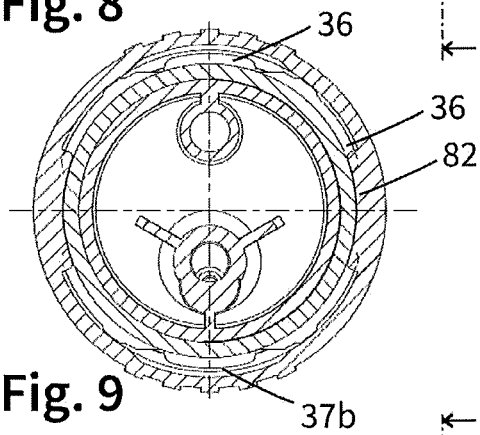
Figure 10:
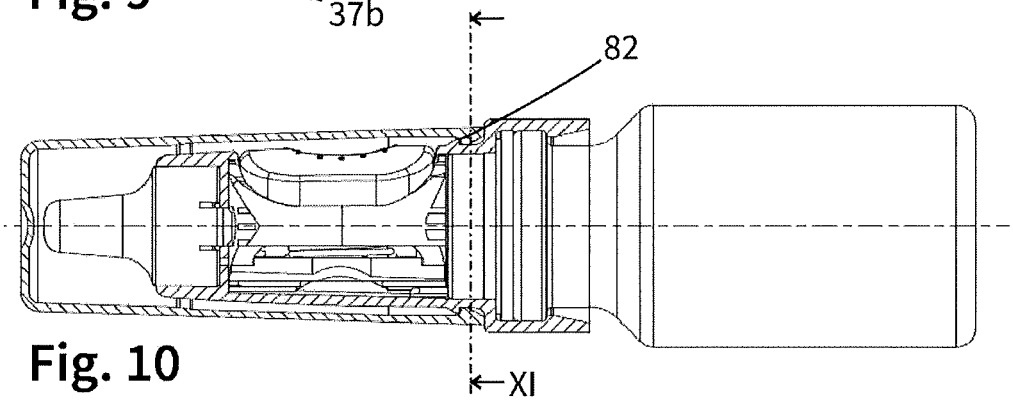
Figure 11:
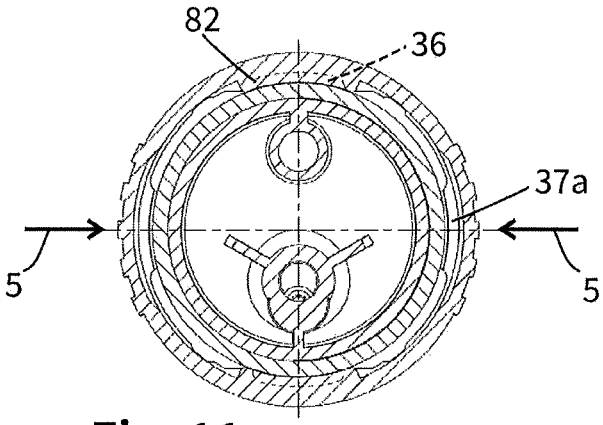
Figure 12:
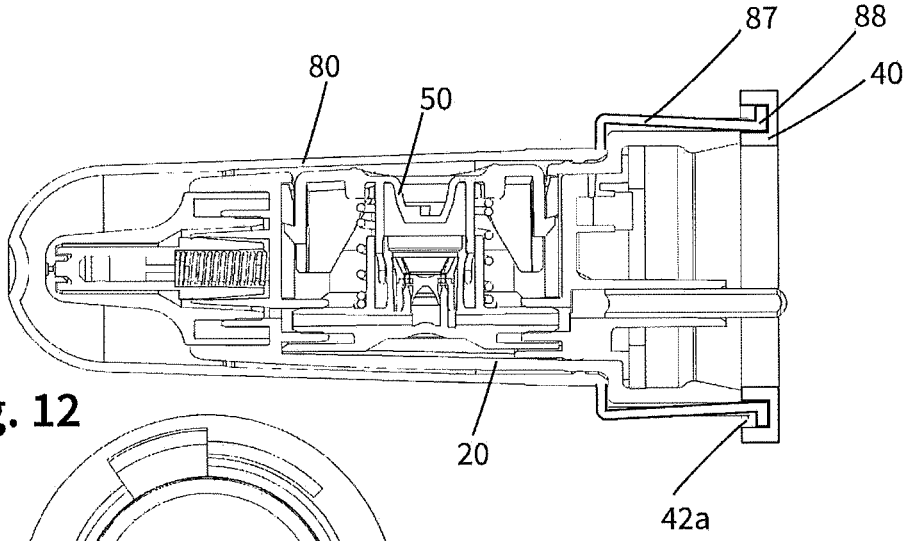
FIGS. 12 to 16 show one exemplary embodiment of a dispenser according to the invention in accordance with the second variant of the invention having a cap which can be secured on the housing via a bayonet coupling.
Figure 13:
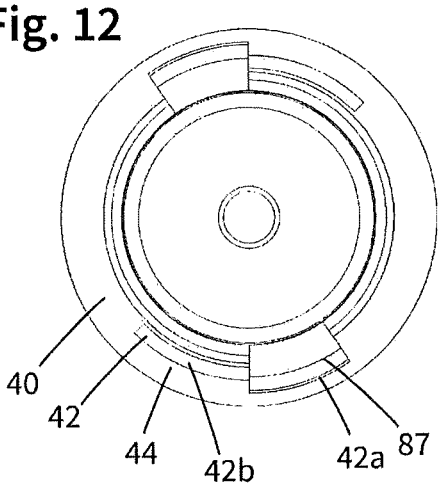

In the case of the refinement of FIGS. 8 to 11, the dispenser 10 has a cap 80 which can be pushed on from the distal end in the direction of the center axis 2 and therefore covers the discharge opening 24 and the push button 50. In this case, the child safety means is provided by virtue of the fact that, as can be seen in FIG. 10, the cap engages with translation locking faces 82 behind corresponding translation locking faces 36 on the housing 20 of the dispenser. In order to release the connection which is produced in this way, the cap 80 has to be pressed together in the direction of the arrows 5. In the orientation of FIGS. 8 and 9, however, the available space 37*b* between the inner side of the cap 80 and the latching web of the housing, on which latching web the translation locking faces 36 are provided, is not sufficiently large, in order to bring the translation locking faces 36, 82 out of engagement with one another. The cap has to be rotated by 90°, with the result that it assumes the state of FIGS. 10 and 11. In said state, a sufficient deformation can be achieved by way of force loading along the arrows 5, with the result that the cap can then be detached.

Proceeding from the secured state of the cap, said cap first of all has to be rotated and then compressed, in order for it to be possible to detach it. This movement sequence cannot be realized at least by infants.

Figure 14:
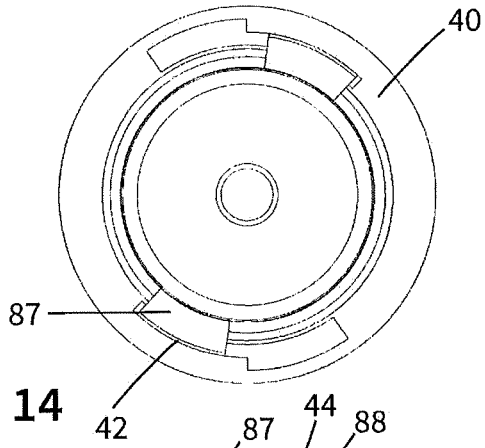
Figure 15:
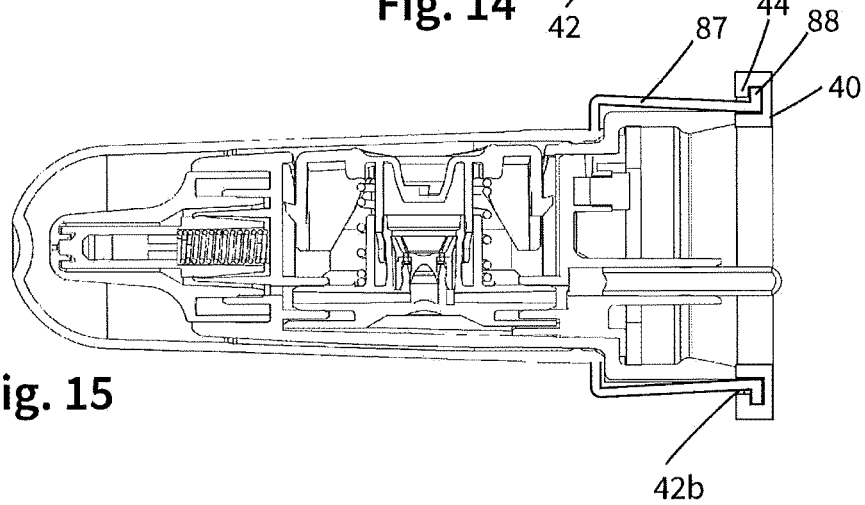

In the case of the exemplary embodiment of FIGS. 12 to 16, a cap 80 is once again used. Said cap 80 has projections 87 which lie opposite one another and at the ends of which latching lugs 88 are provided. Furthermore, a bayonet ring 40 is provided on the housing 20 of the dispenser. As can be seen from FIG. 13, said bayonet ring has in each case one slotted guide 42 on both sides, said slotted guides having in each case a push-in region 42*a* and a holding region 42*b*. In the holding region 42*b*, the slotted guides are tapered with respect to the push-in section 42*a* by way of a web 44. The cap 80 is fitted, by the projections 87 being pressed toward one another slightly, with the result that the latching lugs 88 can dip into the push-in regions 42*a*. Subsequently, the cap is rotated with respect to the bayonet ring 40, with the result that the state of FIGS. 14 and 15 is set. Direct detaching of the cap is no longer possible in this state, since the latching lugs 88 cannot escape through the tapered holding region 42*b* of the slotted guide 42. The cap 80 therefore first of all has to be rotated back with respect to the bayonet ring 40.

Figure 16:
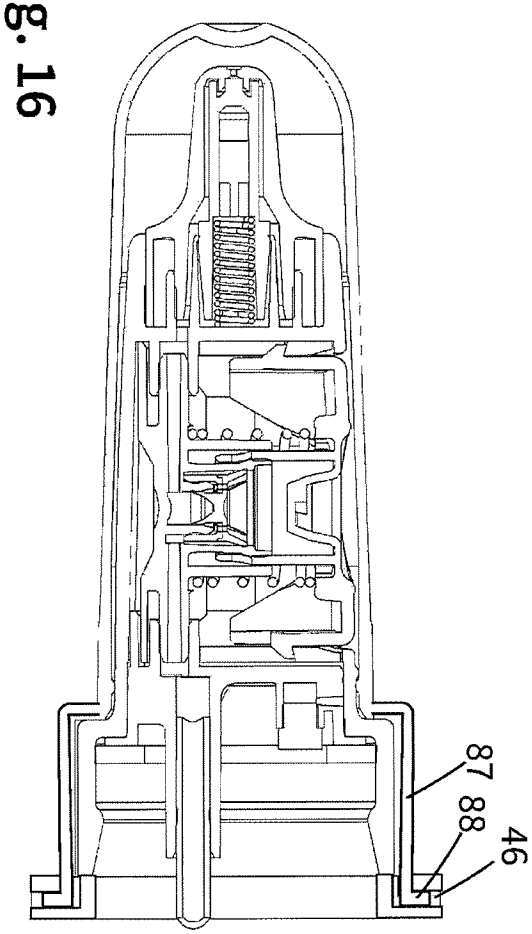

A particular degree of safety results if the holding region 42*b* is configured in accordance with FIG. 16. Here, an outwardly directed recess 46 is also provided in the holding region, into which recess 46 latching lugs 88 dip radially. A cap which is secured in this way can only be released if first of all the projections 87 are pressed toward one another in the direction of the arrows 5, the cap 80 is then turned with respect to the bayonet ring 40, and is only subsequently detached from the housing 20.

The bayonet ring 40 can be of fixed configuration so as to rotate with the remaining housing sections, in particular the circumferential face 23. Instead of the cap 80 or in addition to the cap 80, it can also be configured such that it can be rotated about the center axis 2, with the result that it is particularly difficult for a child to hold the projections 87 in a pressed manner while the bayonet ring 40 and the cap 80 are rotated with respect to one another.

Figure 17:
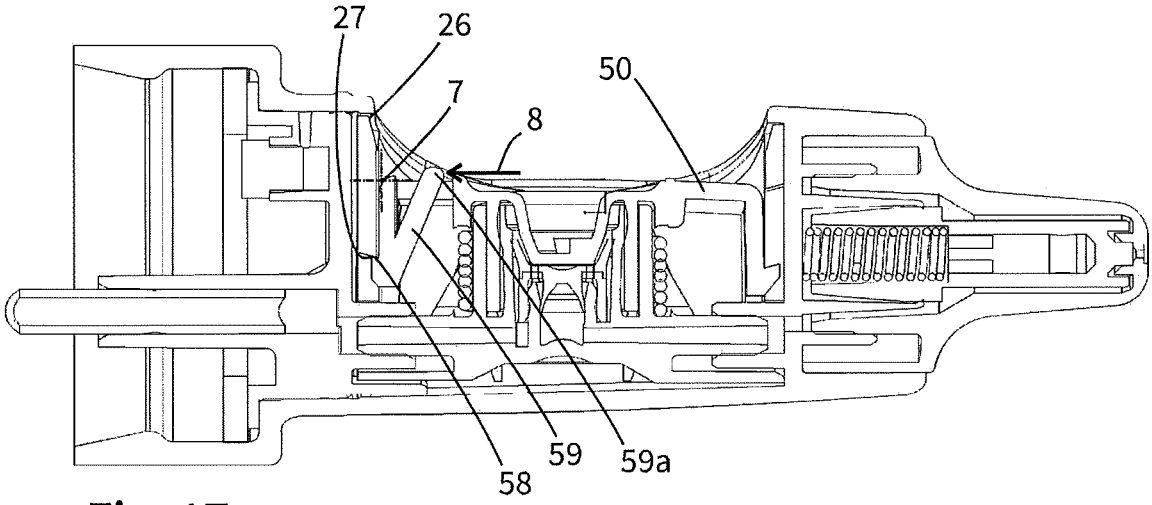
FIGS. 17 to 18 show one exemplary embodiment of a dispenser according to the invention in accordance with the third variant of the invention having a push button which can be fixed in the radial direction.
Figure 18:
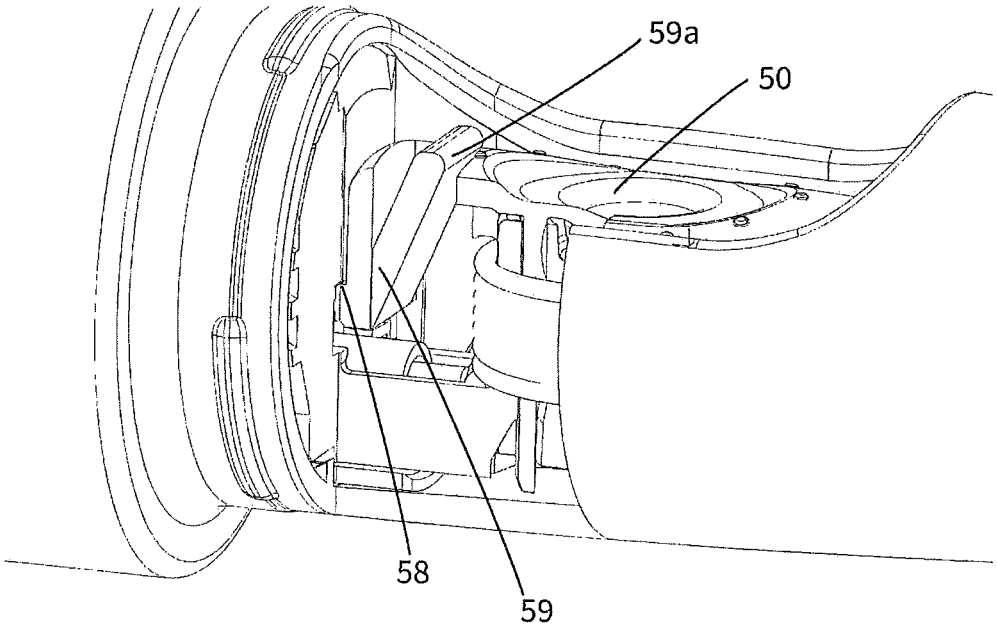

In the case of the refinement of FIGS. 17 and 18, the child safety means is formed by way of the push button 50 itself. The push button 50 has a tilting element 59 which is an integral part of the push button 50 but can be pivoted with respect to the latter about a pivot axis 7. A fixing element 58 is provided on said tilting element 59, which fixing element 58, in the pressed-in state of the push button 50, snaps behind a corresponding fixing edge 27 of the housing and therefore secures the push button in the pressed state. Proceeding from said secured state, a release can be achieved only by way of loading a release face 59*a* of the tilting element 59 with a force which is effected in the direction of the arrow 8, which release leads to the push button 50 jumping automatically into its radially outward end position, from where it can be actuated again. It goes without saying that said design of a child safety means can be combined via the design of the push button 50 with further child safety features, as are described in this application with regard to a rotating sleeve or a cap. The use of a plurality of the described tilting elements 58 on different sides of the push button is also possible.

Figure 19:
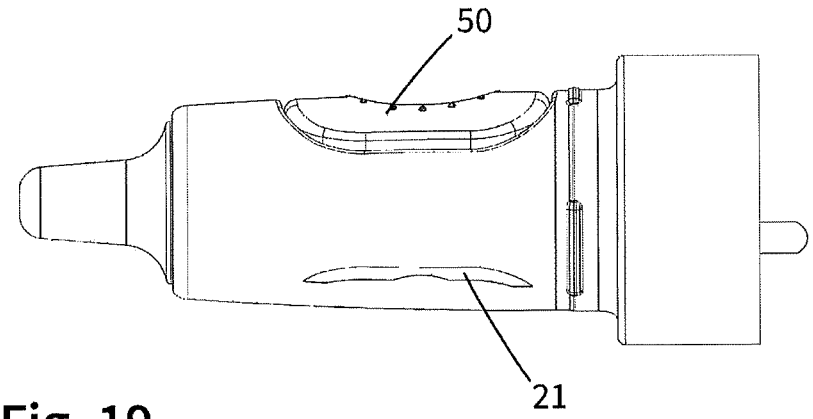
FIGS. 19 to 20 show one exemplary embodiment of a dispenser according to the invention in accordance with the fourth variant of the invention having a push button which, upon actuation, deploys projections on a counter-face.
Figure 20:
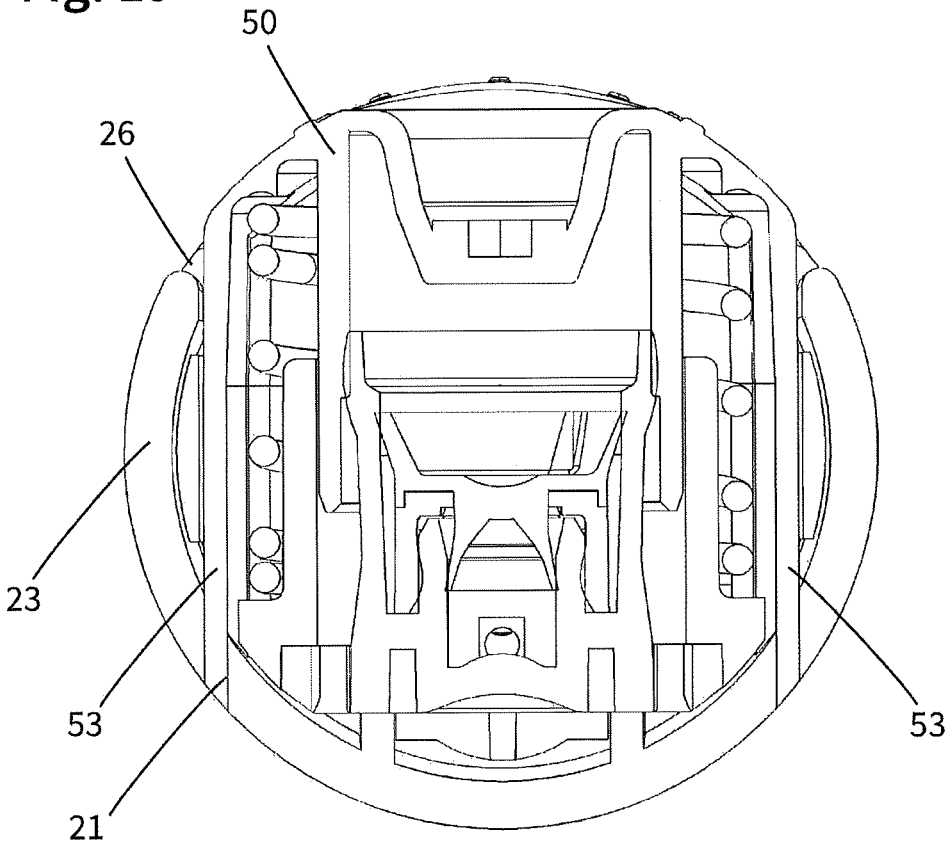

In the case of the design of FIGS. 19 and 20, an aperture 21 is provided on that side of the circumferential face 23 which lies opposite the cutout 26 for the push button 50. As can be seen from the sectional illustration of FIG. 20, the push button is provided with at least one projection 53 which protrudes as far as into said aperture 21 and is pressed out here in the case of an actuation of the push button. This makes the handling for a child very difficult, since he/she can apply the required actuating force only by way of applying a resisting force in a manner which lies opposite the push button 50. This requires a dexterity which is frequently not present in children, however, in order to exert a firm hold here in such a way that the projections 53 can nevertheless exit to the outside through the apertures 21.

Figure 21:
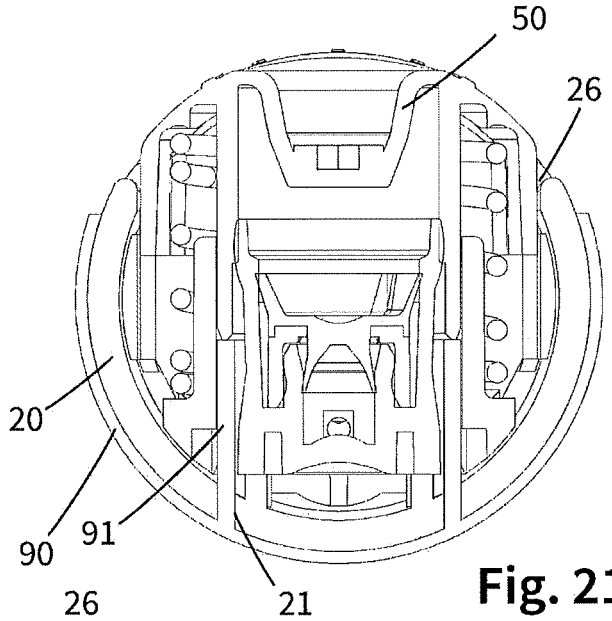
FIGS. 21 to 23 show one exemplary embodiment of a dispenser according to the invention in accordance with the fourth variant of the invention, which has a securing shell which prevents the actuation in the attached state.
Figure 22:
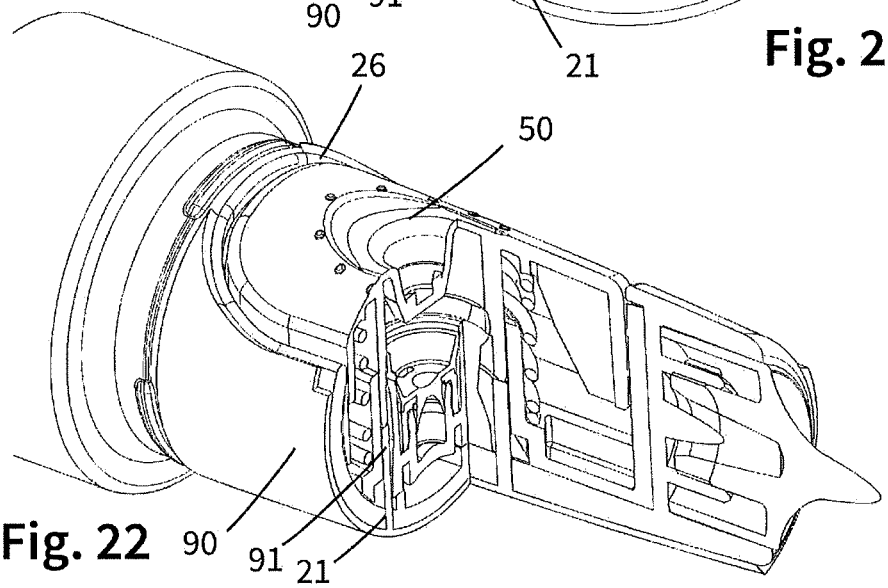
Figure 23:
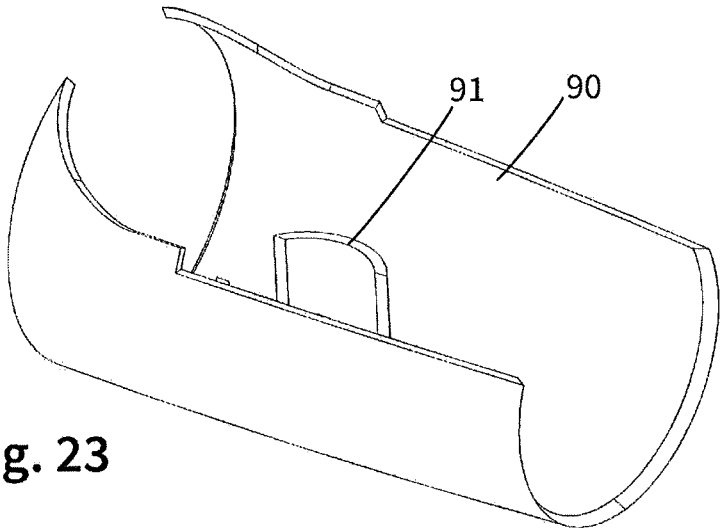

A design which is used to this end is depicted in FIGS. 21 to 23. Apertures 21 are also provided here on the side which lies opposite the recess 26. In addition, however, a securing shell 90 is provided which is shown separately in FIG. 23. Said securing shell 90 has projections 91 on the inner side, which projections 91 are adapted with regard to their shape to the apertures 21 in the housing 20. If the shell 90 is clipped fixedly on the housing in the way which is shown in FIG. 22, said projections 91 prevent it being possible for the push button 50 to be pressed down. For a child who would naturally hold the dispenser firmly in the region of the securing shell 90, it is comprehensible only with difficulty why this prevents the push button 50 from being pressed down.

Figure 24:
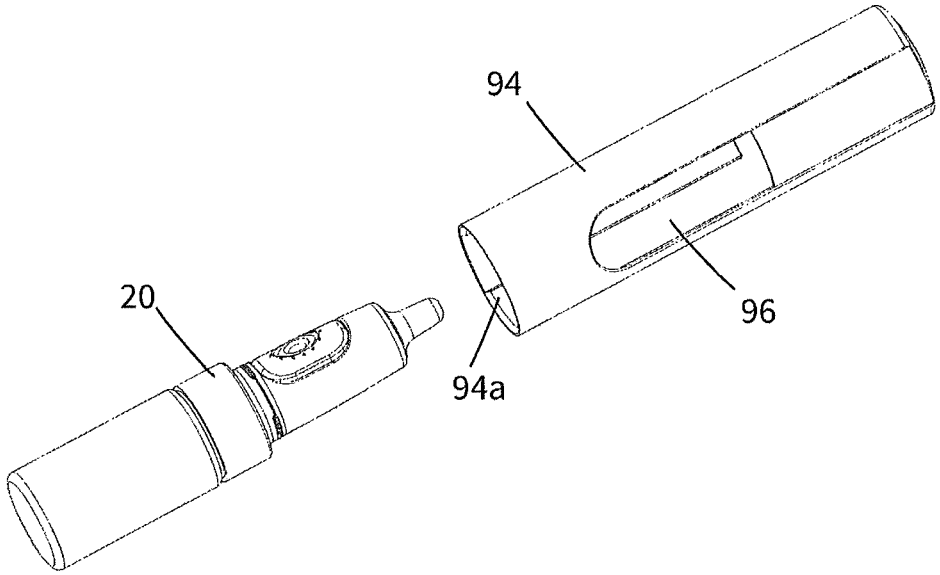
FIGS. 24 to 25 show one exemplary embodiment of a dispenser according to the invention in accordance with the fifth variant of the invention having a receiving sleeve.
Figure 25:
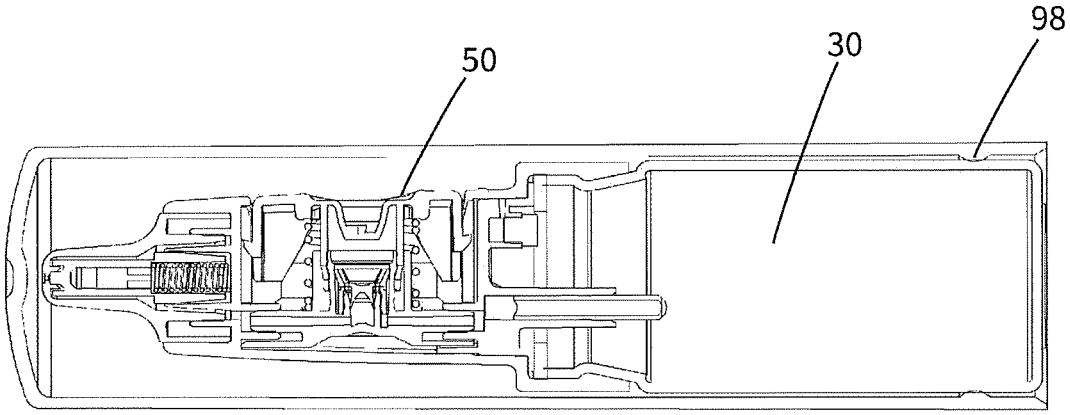

In the case of the design of FIGS. 24 and 25, a receiving sleeve 94 which is adapted to the housing 20 of the dispenser is provided. As can be seen using the figures, said receiving sleeve 94 is of sufficiently large design, with the result that the housing 20 can be received completely therein when it is pushed in through an open side 94*a*. The housing 20 is held in the receiving sleeve in a non-positive manner, this being made possible in the present case by way of a clamping ring 98 which bears against an outer side of the reservoir 30. In order to use the dispenser, the housing is pressed through lateral recesses 96 in the direction of the open end 94*a* and is thus retrieved from the latter. A movement sequence of this type, in the case of which sliding out of the housing 20 is provided, has proven difficult to realize for children.

Figure 26:
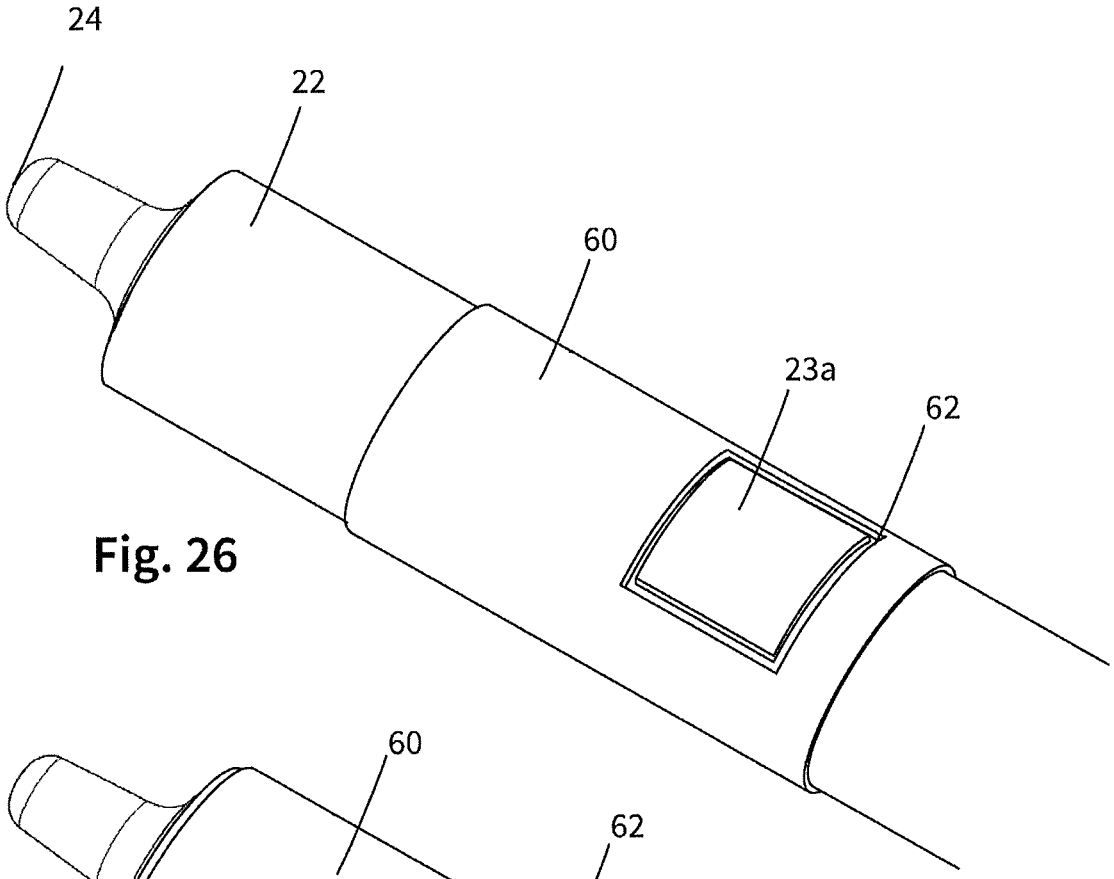
FIGS. 26 to 27 show one exemplary embodiment of a dispenser according to the invention in accordance with the first variant of the invention having a sliding sleeve which is secured via a deflectable locking pawl.
Figure 27:
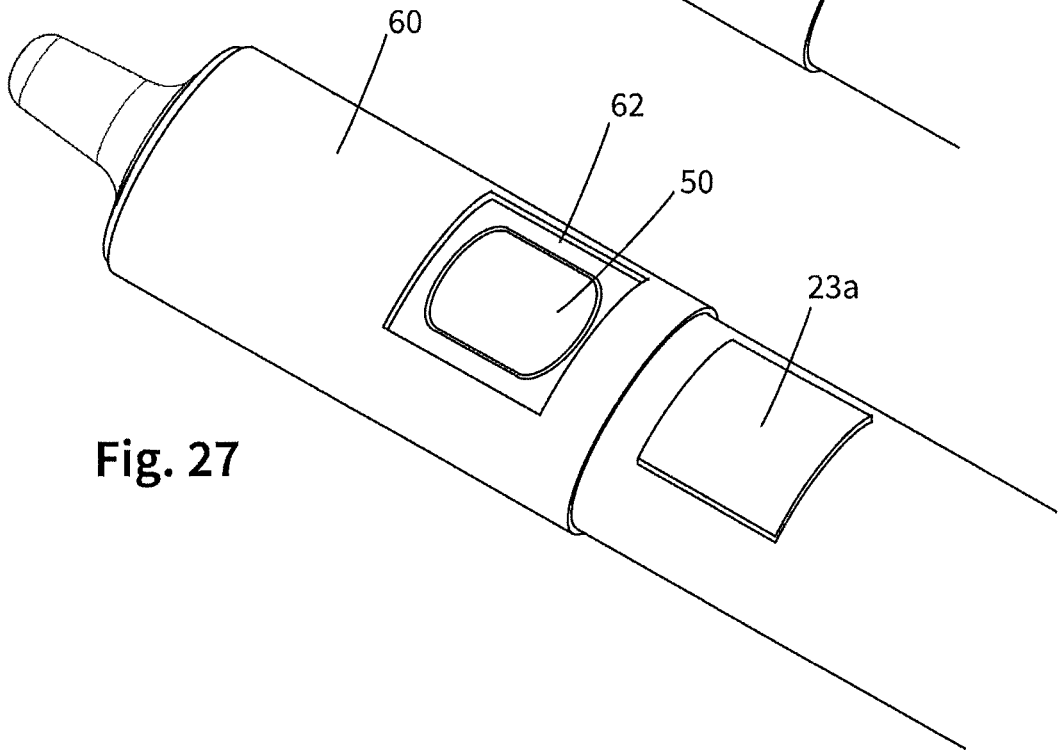

FIGS. 26 and 27 show one variant of the dispenser of FIGS. 2 to 5. Said dispenser also has a sleeve 60 which is pushed onto the housing 22 and can be moved to a limited extent with respect to the housing 60 but cannot be detached. However, the sleeve 60 of said refinement is not rotationally movable, but rather can be moved translationally between the two end positions of FIGS. 26 and 27.

In the position of FIG. 26, the push button 50 of the dispenser is not accessible, since it is covered by the sliding sleeve 60. The sliding sleeve 60 cannot be moved directly, since it is locked by the locking pawl 23*a* which protrudes into the cutout 62 of the sliding sleeve 60.

Figure 34:
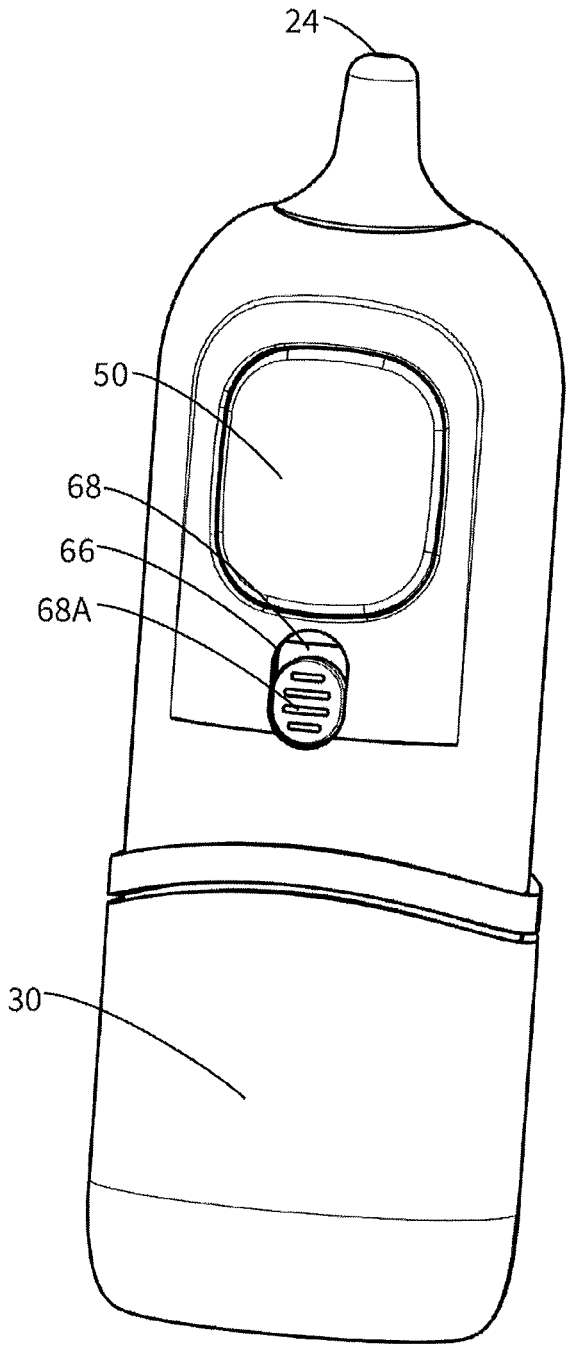
FIGS. 34 to 36B show a further exemplary embodiment in accordance with the third variant of the invention having a lockable push button.
Figure 35:
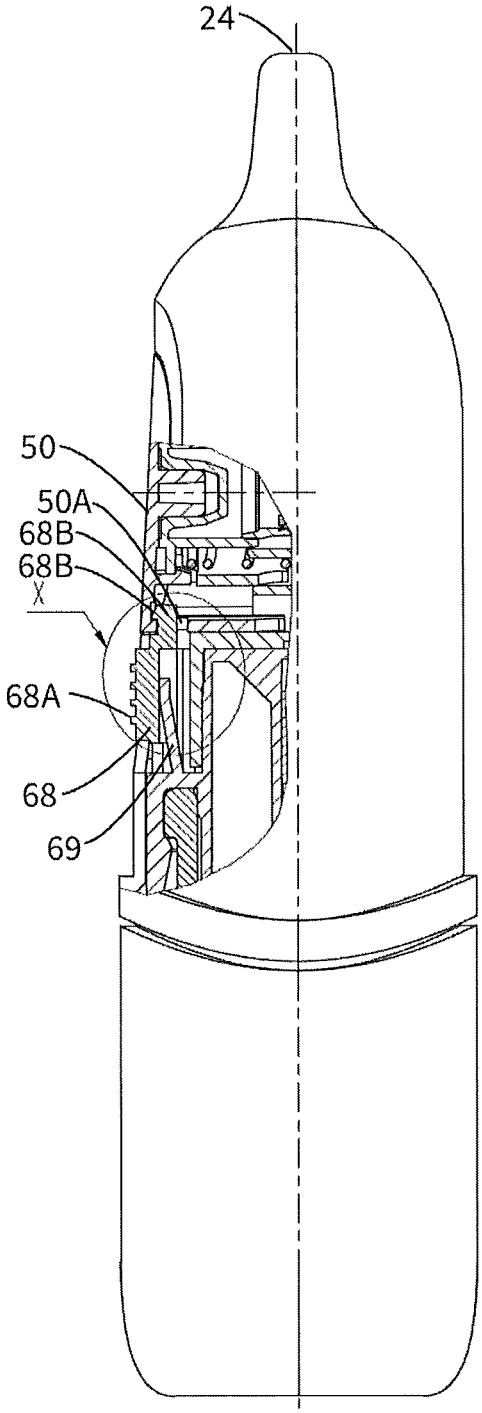

In order for it to be possible to use the dispenser, the locking pawl 23*a* first of all has to be pressed in. It is only subsequently possible to displace the sleeve 60, with the result that it assumes the position of FIG. 34. In said position, the push button 50 can then be pressed in radially through the cutout 62, and a discharge can therefore be brought about.

Figure 28:
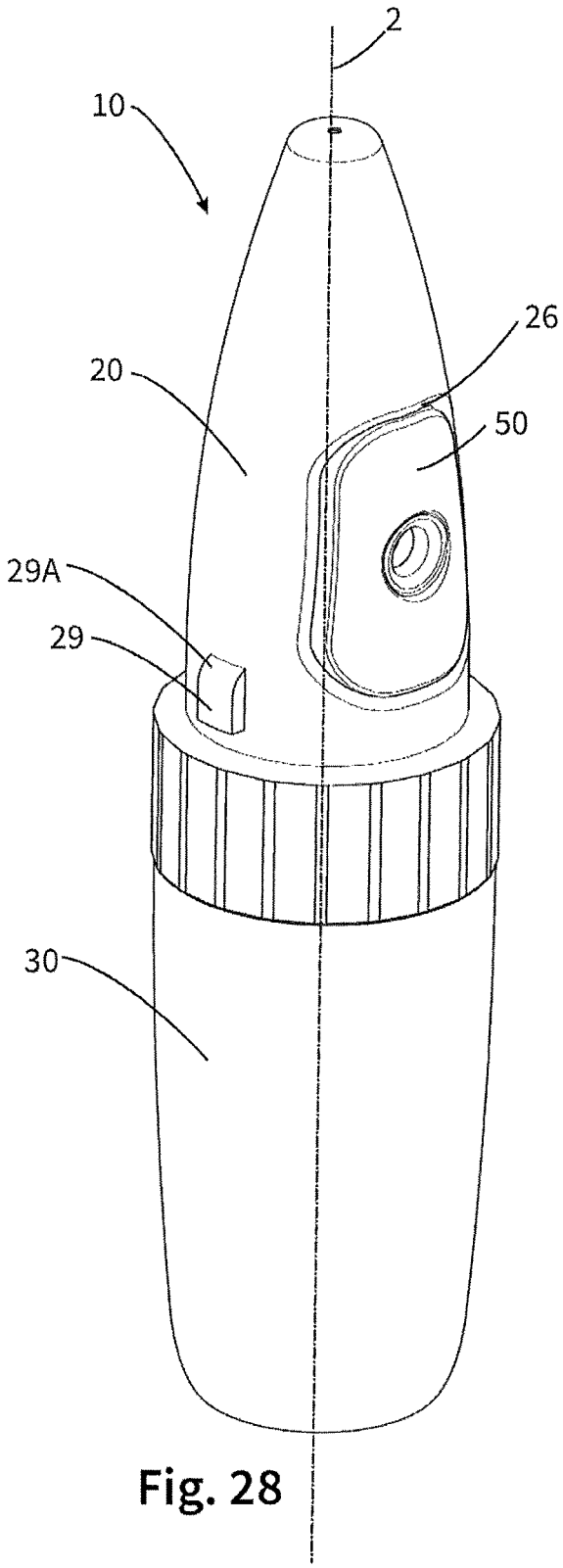
FIGS. 28 to 33 show a further exemplary embodiment in accordance with the second variant of the invention having a cap which can be removed by way of deformation, and one variant in this regard.
Figure 29:
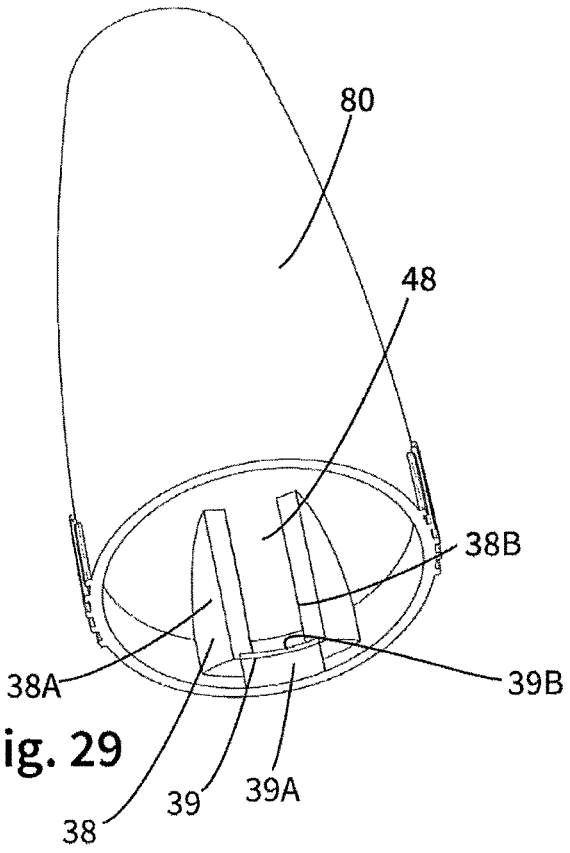

FIGS. 28 to 33 show a further exemplary embodiment in accordance with the second variant of the invention having a substantially rotationally symmetrical and, as a result, rotatable cap 80 which can be detached by way of deformation. FIGS. 28 and 29 show the housing 20 with an integrated liquid reservoir 32 and a distal discharge opening 24 firstly, and said cap 80 for repeated detaching and fitting onto the housing 20 secondly. As in the preceding exemplary embodiments, the dispenser can be actuated by means of a lateral push button 50. By way of pressing in, liquid is pumped out of the liquid reservoir 32 to the discharge opening 24.

In order to achieve a child safety means, the housing has two outwardly pointing cams 29 on opposite sides which are covered by the cap 80 when the latter is fitted. In a corresponding manner to this, in each case one coupling structure is provided on the inner side of the cap 80, which coupling structure comprises two axially extending ribs 38 and a holding element 39 which, together with the ribs 38, delimits a receiving region 48.

The ribs 38 have in each case rotation locking faces 38B in the direction of the receiving region 48. On the opposite sides, the ribs 38 are provided in each case with an outwardly pointing bevel 38A, that is to say a face which is tilted with respect to the circumferential face and counter to the radial direction.

The holding element 39 has a translation locking face 39B in a manner which points upward. In a manner which points downward, it likewise has a bevel 39A which can be considered to be optional, however.

The receiving region 48 is provided for receiving said cam 29 of the housing 20. The cam 29 is introduced as intended into said receiving region 48, by the cap 80 being pushed on in a relative rotation position, in which the cam 29 is not aligned with the coupling structure. Subsequently, the cap 80 is rotated with respect to the housing 20, with the result that it passes over one of the bevels 38A into the receiving region 48.

In this state, the cap 80 is secured. The rotation locking faces 38B counteract a rotational movement together with cam-side rotation locking faces, and therefore prevent the cam 29 from leaving the receiving space 48 as a result of a rotational movement. The holding element 39 prevents direct pulling off of the cap 80 by means of its translation locking face 36.

Figure 30A:
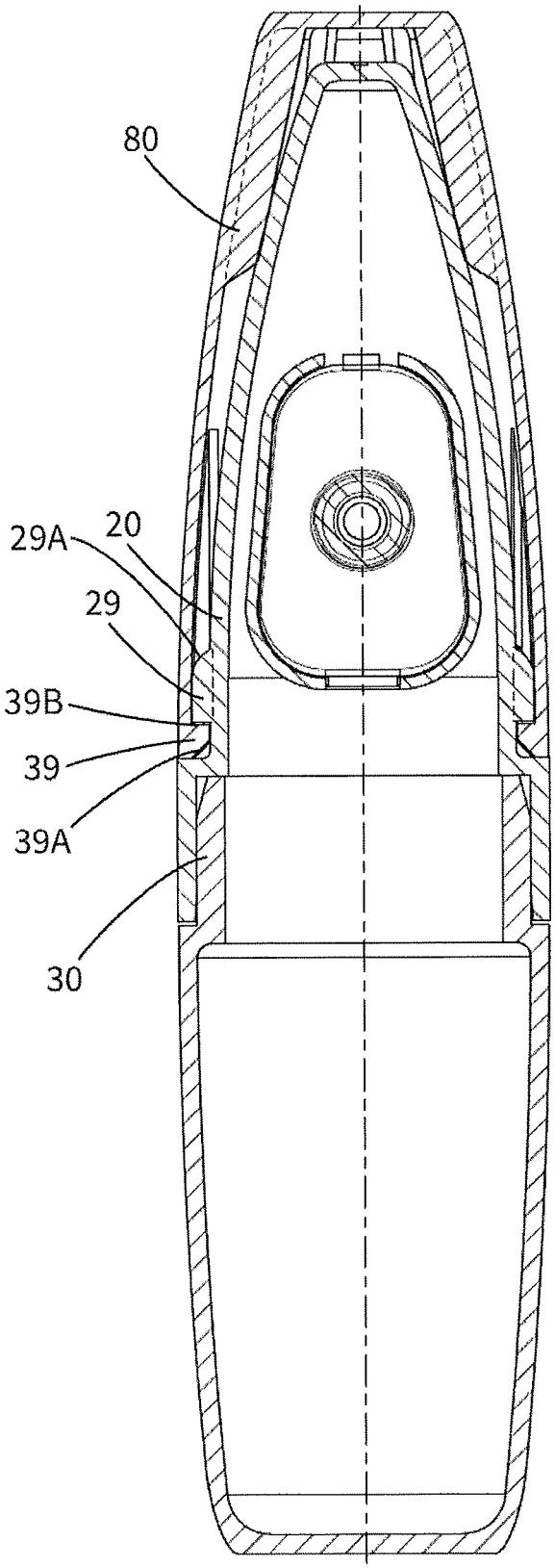
Figure 30B:
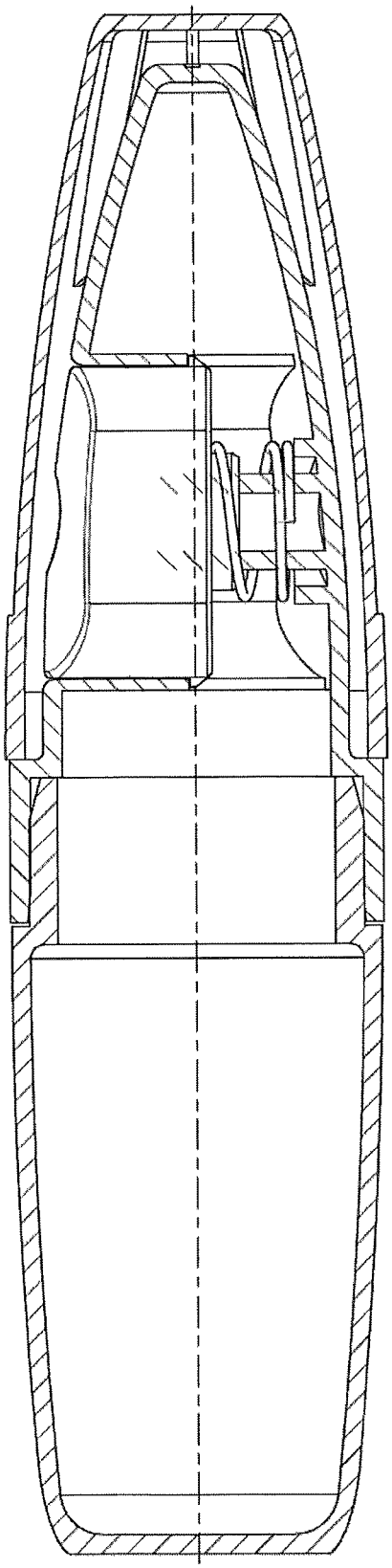

The above-described secured state is illustrated in FIGS. 30A and 30B. It can be seen here, in particular, that the cams 29 prevent, jointly with the translation locking face 39B, direct pulling off of the cap 80.

Figure 31A:
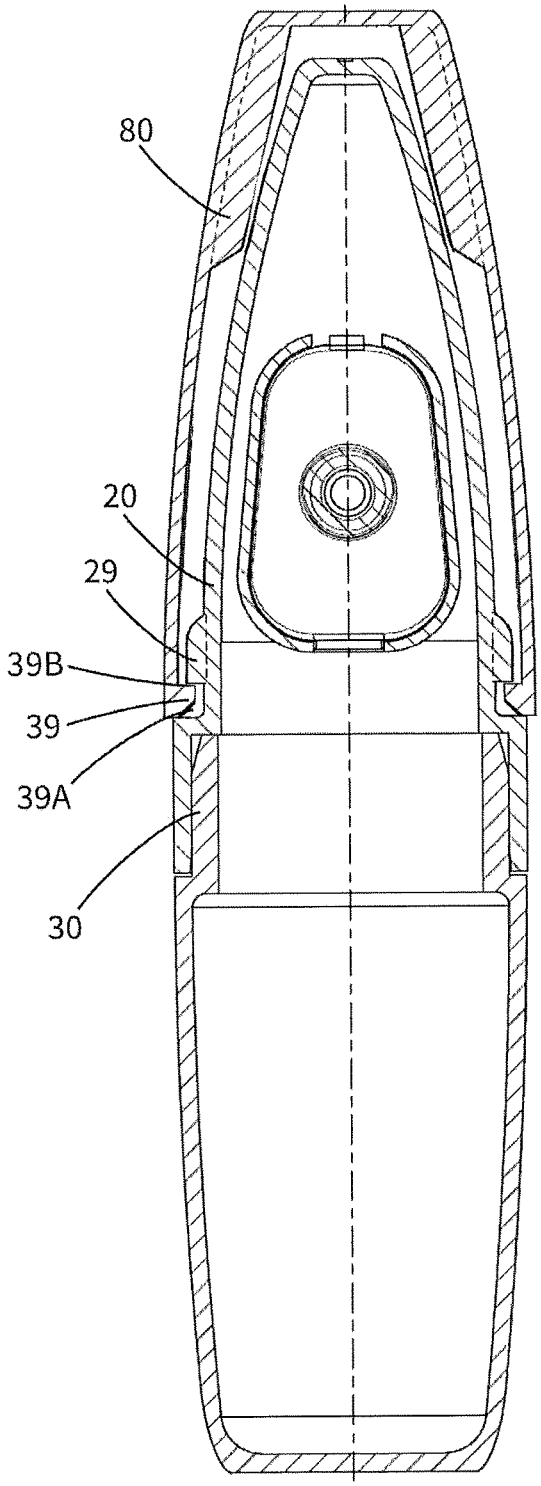
Figure 31B:
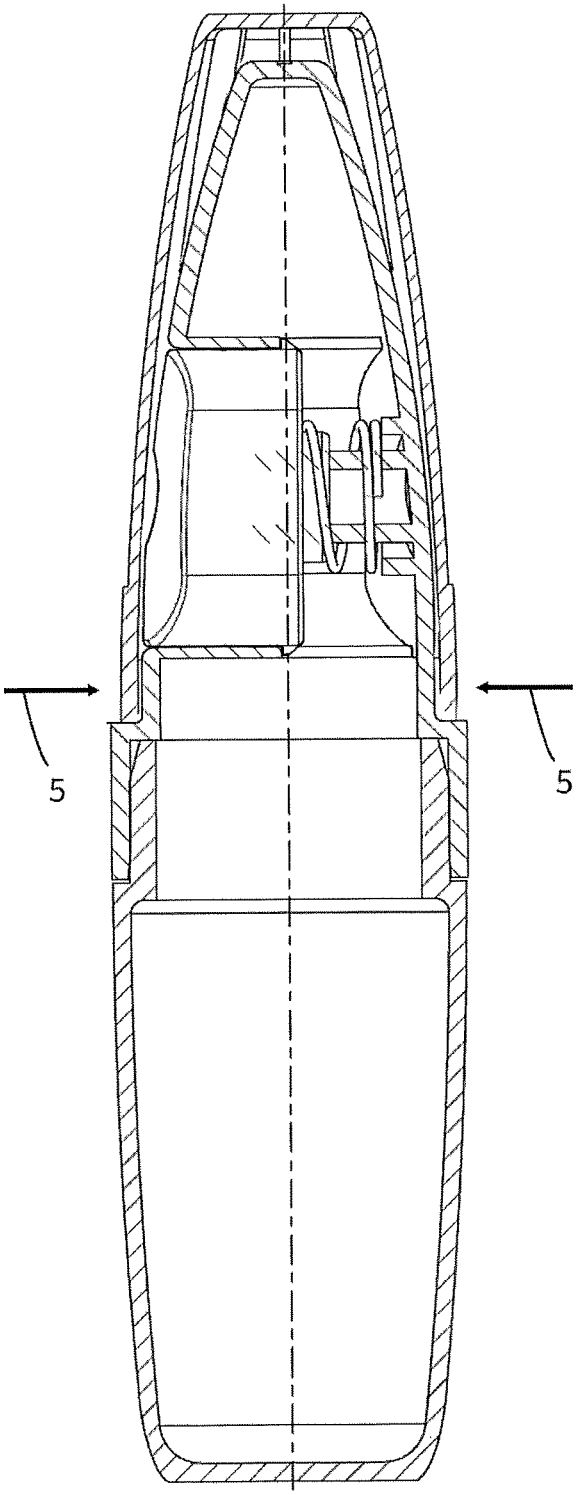

In order for it to be possible to detach the cap 80 starting from said secured state, force loading is required, as is illustrated by way of the arrows 5 in FIGS. 31A and 31B. Said manual force loading also brings about an oval deformation of the cap 80 on the inner side of the cap 80 in the region of the coupling structure which is arranged offset by 90' with respect to the force loading. Said inner side of the cap 80 is pressed outward, with the result that the rotation locking faces 38B lose their effect. The cap 80 can then be rotated and subsequently pulled off.

The deformation of the cap 80 is not sufficient, however, to also bring the translation locking face 39A out of engagement with the cam 29, with the result that direct detaching is scarcely possible even in the case of deformation. FIG. 31A illustrates this. Direct detaching is possible at best by way of force loading and dexterity which are scarcely possible for a child.

Together with a corresponding bevel 29A on the cam 29, the abovementioned bevel 39 can allow, however, the cap to nevertheless be fitted directly, that is to say in an aligned orientation of the cam and the recess. During this, a deformation is achieved indirectly which can scarcely be achieved by way of manual radial force loading of the cap.

Figure 32:
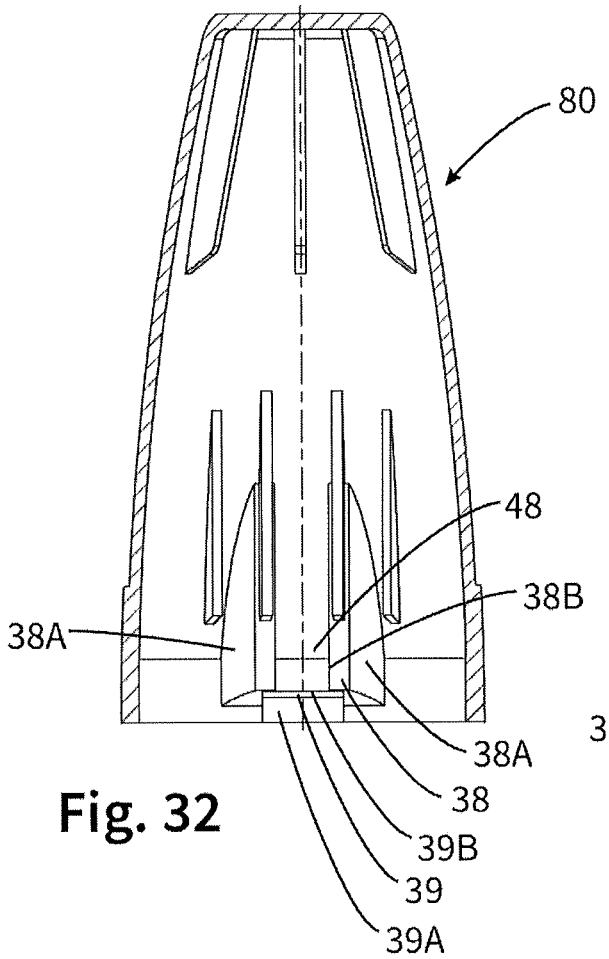
Figure 33:
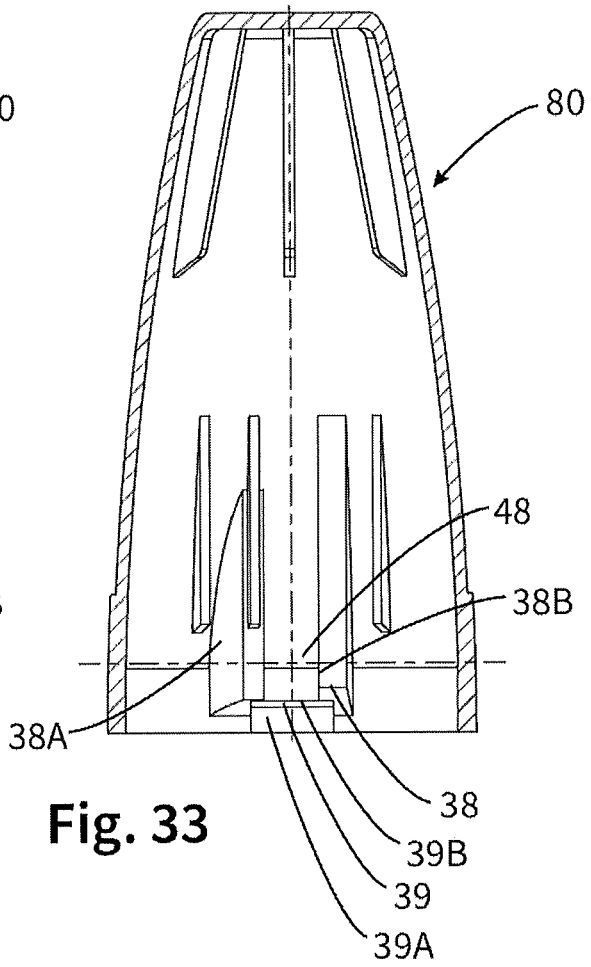

FIGS. 32 and 33 illustrate one possible variation. The cap of FIG. 32 corresponds to the above-described cap with two ribs 38 which in each case have a bevel 38A. The coupling structure on the cap 80 can therefore be introduced into the receiving space 48 in both rotational directions.

In the case of the design of FIG. 33, in contrast, the right-hand rib 38 is of different configuration. It does not have an inclined surface and is preferably also higher in the radial direction than the left-hand rib 38. Therefore, the introduction and possibly also the removal of the cam 29 from the receiving space 48 are possible only in in each case one rotational direction.

In the case of the present example, the housing 20 has two cams 29, and the cap 80 correspondingly has two coupling structures which are provided in each case so as to lie opposite one another. However different numbers can also be provided in each case, and it is not absolutely necessary that the same number of coupling structures firstly and cams secondly is provided.

The dispenser according to FIGS. 34, 35, 36A and 36B is a dispenser having a child safety means which is not realized via a cap, but might also be additionally realized in this way. Primarily, however, it is provided in the present case that the child safety means is brought about in a similar manner to the design of FIGS. 17 and 18 by way of a locking capability of the push button 50. For this purpose, in addition to the cutout 26 for the push button 50, a second cutout 66 is provided in the housing 20, through which second cutout 66 a blocking element 68 which can be displaced orthogonally with respect to the push button can be loaded with force by means of a force loading face 68A. Said blocking element 68 has a distal end 68B, a cutout 50A being provided in a corresponding manner thereto in an inner side wall of the push button 50. The blocking element 68 can engage into said cutout 50A.

Figure 36A:
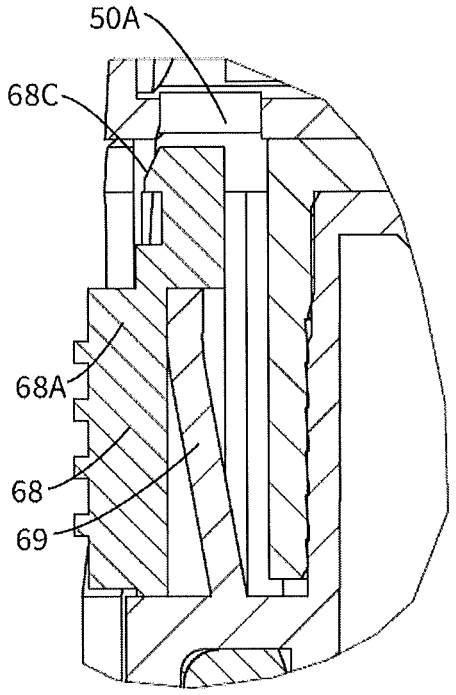
Figure 36B:
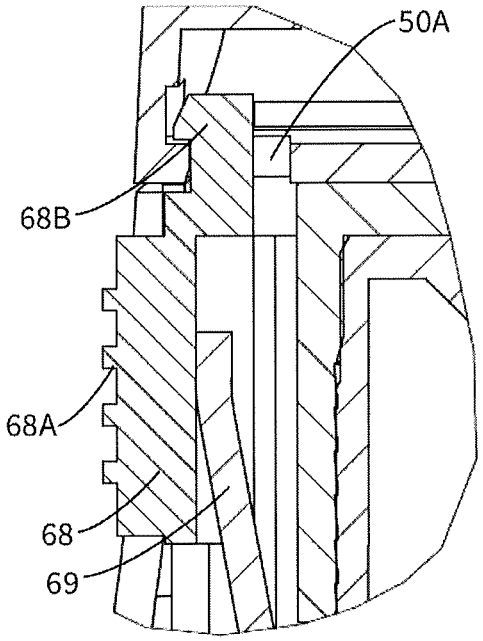

FIGS. 36A and 36B show the released and the locked state of the blocking element 68.

Starting from the released state of FIG. 36A, the blocking element is displaced upward in relation to the figures, a region of a housing edge being moved slightly radially counter to the force of the spring element 69 by means of a bevel 68C. As soon as the distal end 68B has engaged into the recess 50A of the push button 50, said spring element brings it about that the distal end 68B which is of hook-like design is snapped into said recess 50A in such a way that subsequently a childproof state is achieved. In said state, the push button 50 cannot be pressed in, and therefore no liquid can be discharged.

In order to pass out of said state back into the released state, the blocking element has to be pressed in counter to the force of the spring element 69, with the result that said snap action is released. Only then can the blocking element 68 be pulled back, with the result that it releases the push button 50.

Various modifications are possible, in order to increase the child safety. For instance, the distal end 68B can have a hook-like shape which is oriented differently than the abovementioned right-hand orientation, with the result that a movement of the blocking element into the released position is possible only as soon as the push button has been pressed down a certain extent. Furthermore, the relative movability of the blocking element 68 with respect to the housing can also be of different configuration. Thus, for example, a rotatable or pivotable blocking element is suitable to make the release additionally more difficult for small children.

The invention claimed is:

1. A dispenser for discharging pharmaceutical liquids comprising:

an elongate housing which is oriented along a center axis;

a discharge opening which is oriented axially in a direction of the center axis at a distal end of the housing;

a liquid reservoir;

a control device having a pump or a switching valve, which control device is connected by way of a first line to the liquid reservoir and by way of a second line to the discharge opening, wherein liquid can be conducted out of the liquid reservoir to the discharge opening by the control device;

a push button which is provided laterally in a cutout of a circumferential face of the housing and which is connected to the control device in such a way that radial pressing in of the push button in the direction of the center axis actuates the control device, with the result that liquid is conducted to the discharge opening;

a rotating sleeve which is open on both sides and is attached on an outer side of the housing such that the rotating sleeve can be rotated about the center axis, or a sliding sleeve which is open on both sides and is attached on the outer side of the housing such that the sliding sleeve can be displaced in the direction of the center axis;

in a locking rotating position or a locking sliding position, the rotating sleeve or the sliding sleeve prevents actuation of the push button; and in a release rotating position or a release sliding position, the rotating sleeve or the sliding sleeve permits the push button to be pressed in radially.

2. The dispenser as claimed in claim 1, wherein:

the rotating sleeve or the sliding sleeve has an actuating cutout which is arranged on an outer side of the push button in the release rotating position or release sliding position and allows access to the push button.

3. The dispenser as claimed in claim 1, further including:

a locking pawl which can be deflected radially toward the center axis that is provided on the housing, wherein the rotating sleeve or the sliding sleeve can be locked by the locking pawl in at least one locking rotating position or locking sliding position, with the result that a deflection of the locking pawl is required in order to rotate the rotating sleeve into the release rotating position or in order to slide the sliding sleeve in the release sliding position.

4. The dispenser as claimed in claim 3, wherein:

the locking pawl is arranged on the housing in such a way that the locking pawl protrudes into an actuating cutout of the rotating sleeve or the sliding sleeve in the locking rotating position or in the locking sliding position; or the locking pawl is connected fixedly to the push button and, in the locking rotating position or the locking sliding position, protrudes into a locking cutout in the rotating sleeve or the sliding sleeve, which locking cutout is separate from the actuating cutout and is arranged offset circumferentially and/or in an axial direction with respect to the actuating cutout.

5. The dispenser as claimed in claim 3, wherein:

the rotating sleeve or the sliding sleeve has a cutout, into which the locking pawl protrudes in a secured state; and a cap has a projection which is shaped in such a way that, after removal of the cap from the housing or from the rotating sleeve or the sliding sleeve, the projection can be introduced into the cutout in such a way that, as a result, the locking pawl can be deflected and subsequently the rotating sleeve can be rotated into the release rotating position or the sliding sleeve can be slid into the release sliding position.

6. The dispenser as claimed in claim 1, wherein:

the rotating sleeve and the housing are provided with rotation locking faces which interact in a positively locking manner and, in the locking rotating position, prevent a rotation of the rotating sleeve with respect to the housing, or the sliding sleeve and the housing are provided with translation locking faces which interact in a positively locking manner and, in the locking sliding position, prevent a displacement of the sliding sleeve with respect to the housing; and the rotating sleeve or the sliding sleeve is manufactured from an elastically deformable plastic which permits a deformation of the rotating sleeve or the sliding sleeve by way of external force loading, by way of which deformation the rotation locking faces or the translation locking faces can be brought out of engagement, with the result that subsequently a rotation of the rotating sleeve or a displacement of the sliding sleeve into the release rotating position or the release sliding position, respectively, is possible.

7. The dispenser as claimed claim 1, further including at least one of the following features:

an outlet valve which opens in a pressure-dependent manner and is connected upstream of the discharge opening;

an applicator tip of the housing is designed as a slim nasal applicator; and a drug in liquid form is situated in the liquid reservoir.

8. A dispenser for discharging pharmaceutical liquids comprising:

an elongate housing which is oriented along a center axis;

a discharge opening which is oriented axially in a direction of the center axis at a distal end of the housing;

a liquid reservoir;

a control device having a pump or a switching valve, which control device is connected by way of a first line to the liquid reservoir and by way of a second line to the discharge opening, wherein liquid can be conducted out of the liquid reservoir to the discharge opening by the control device;

a push button which is provided laterally in a cutout of a circumferential face of the housing and which is connected to the control device in such a way that radial pressing in of the push button in the direction of the center axis actuates the control device, with the result that liquid is conducted to the discharge opening; and a detachable cap which, in a fitted state, covers the discharge opening and can be detached from the housing in the direction of the center axis toward the distal end;

the cap and the housing have interacting fixing elements which, in a relative engagement position, prevent detaching of the cap from the housing, and have to be moved into a relative release position prior to detaching of the cap to allow for the cap to be removed from the housing, the relative release position being arrived at by way of:

deformation of the cap prior to detaching of the cap, and/or rotation of the cap about the center axis prior to detaching of the cap, and/or relative movement of a housing section of the housing, on which housing section the fixing element is provided, with respect to the circumferential face of the housing, prior to detaching of the cap;

in which relative release position, the cap and the housing do not counteract the detaching of the cap.

9. The dispenser as claimed in claim 8, wherein:

the fixing elements interact in a positively locking manner in the form of translation locking faces which, in the case of a fitted cap, prevent axial detaching of the cap from the housing; and in at least one rotating position of the cap with respect to the housing, there is a sufficient spacing from the housing in a deformation region of the cap, with the result that the cap can be deformed by way of radial force loading in such a way that the translation locking faces can be brought out of engagement, with the result that subsequently detaching of the cap is possible.

10. The dispenser as claimed in claim 9, wherein:

in at least one rotating position of the cap with respect to the housing, there is no sufficient spacing from the housing in a deformation region of the cap, with the result that the cap cannot be deformed sufficiently by way of radial force loading, in order to bring the translation locking faces out of engagement.

11. The dispenser as claimed in claim 9, wherein:

the cap and the housing are provided with interacting rotation locking faces which, in the case of a fitted cap, prevent a rotation of the cap from the housing, the cap and the housing being configured in such a way that the rotation locking faces can be brought out of engagement with one another by way of radial force loading of the cap; and having at least one of the following additional features:

at least one rotation locking face is assigned an oblique face which is tilted with respect to a tangential direction and by which the cap can overcome a housing side rotation locking face unidirectionally without manual radial force loading of the cap;

a second cap-side rotation locking face is provided offset in a circumferential direction with respect to a cap-side rotation locking face, with the result that a receiving region for a housing-side cam remains between the cap-side rotation locking face, on which housing-side cam the corresponding housing-side rotation locking faces are provided; and a second housing-side rotation locking face is provided offset in the circumferential direction with respect to a housing-side rotation locking face, with the result that a receiving region for a cap-side cam remains between the housing-side rotation locking face, on which cap-side cam the corresponding cap-side rotation locking face is provided.

12. The dispenser as claimed in claim 8, further including:

one of the fixing elements comprises a holding lug on the cap;

wherein the housing has a bayonet ring with a slotted guide which extends in a circumferential direction, the slotted guide being sufficiently large in a slide-in region to permit sliding in of the holding lug, and being provided in a holding section with a tapering section, the tapering section being one of the fixing elements, with the result that the holding lug, in the case of an arrangement in said holding section, cannot be pulled axially out of the slotted guide; and in the case of a fitted cap, the bayonet ring and the cap can be rotated with respect to one another about the center axis.

13. The dispenser as claimed in claim 12, wherein:

the bayonet ring has a cutout, into which the holding lug of the cap can engage radially if the holding lug is situated in the holding section of the slotted guide, such that a relative rotation of the cap with respect to the bayonet ring is possible only after radial movement of the holding lug out of the cutout.

14. A dispenser for discharging pharmaceutical liquids comprising:

an elongate housing which is oriented along a center axis;

a discharge opening which is oriented axially in a direction of the center axis at a distal end of the housing;

a liquid reservoir;

a control device having a pump or a switching valve, which control device is connected by way of a first line to the liquid reservoir and by way of a second line to the discharge opening, wherein liquid can be conducted out of the liquid reservoir to the discharge opening by the control device; and a push button which is provided laterally in a cutout of a circumferential face of the housing and which is connected to the control device in such a way that radial pressing in of the push button in the direction of the center axis actuates the control device, with the result that liquid is conducted to the discharge opening;

the push button and the housing being provided with interacting fixing elements which permit radially acting fixing of the push button in a fixing position with respect to the housing.

15. The dispenser as claimed in claim 14, wherein:

the fixing elements are configured for fixing the push button in a pushed-in state.

16. The dispenser as claimed in claim 14, wherein:

the fixing elements are configured for automatically latching in, such that a movement of the push button radially to an outside or radially to an inside brings about fixing of the push button.

17. The dispenser as claimed in claim 14, wherein:

one of the fixing elements can be moved transversely with respect to a radial direction in order to establish and to release the fixing position; and the movable fixing element is provided on a tilting element which has a release face for manual force loading, by which the tilting element can be tilted, such that said fixing element can be brought out of engagement with the other fixing element as a result.

18. The dispenser as claimed in claim 14, wherein:

one of the fixing elements comprises a slide which can be displaced with respect to the housing between the fixing position and a release position; and the slide and the push button are configured for interacting in a positively locking manner in the fixing position, a depression or aperture being provided on the push button for this purpose, into which depression or aperture the slide engages in the fixing position and out of which depression or aperture the slide is pulled in the release position.

19. The dispenser as claimed in claim 18, wherein:

the slide has a force loading face which is separate from the push button, wherein said force loading face can be operated through a cutout of the housing.

20. A dispenser for discharging pharmaceutical liquids comprising:

an elongate housing which is oriented along a center axis;

a discharge opening which is oriented axially in a direction of the center axis at a distal end of the housing;

a liquid reservoir;

a control device having a pump or a switching valve, which control device is connected by way of a first line to the liquid reservoir and by way of a second line to the discharge opening, wherein liquid can be conducted out of the liquid reservoir to the discharge opening by the control device; and a push button which is provided laterally in a cutout of a circumferential face of the housing and which is connected to the control device in such a way that radial pressing in of the push button in the direction of the center axis actuates the control device, with the result that liquid is conducted to the discharge opening;

the housing having at least one aperture in a manner which lies opposite the cutout of the circumferential face and in which the push button is arranged; and the push button being coupled to at least one projection which, wherein the push button being pressed in, is pushed through the at least one aperture out of the housing, or at least one locking part which can be detached from the housing or can be moved with respect to the housing is provided, which locking part, in a locking position, protrudes by a projection through the aperture into the housing and prevents the push button being pressed down.

21. The dispenser as claimed in claim 20, wherein:

the locking part is configured as a removable locking part and is adapted to the housing in such a way that the locking part can be fastened to the housing in a radial direction.

22. The dispenser as claimed in claim 21, wherein:

the locking part has a shell shape which is adapted to an outer contour of the housing, engages around the housing over an angle of more than 180° in a fastened state, and has an inner side, on which at least one projection is provided.

23. A dispenser for discharging pharmaceutical liquids comprising:

an elongate housing which is oriented along a center axis;

a discharge opening which is oriented axially in a direction of the center axis at a distal end of the housing;

a liquid reservoir;

a control device having a pump or a switching valve, which control device is connected by way of a first line to the liquid reservoir and by way of a second line to the discharge opening, wherein liquid can be conducted out of the liquid reservoir to the discharge opening by the control device;

a push button which is provided laterally in a cutout of a circumferential face of the housing and which is connected to the control device in such a way that radial pressing in of the push button in the direction of the center axis actuates the control device, with the result that liquid is conducted to the discharge opening; and a receiving sleeve, the inner volume of which is adapted to an outer shape of the housing in such a way that the housing including the liquid reservoir can be received completely therein;

an inner wall of the receiving sleeve and outer faces of the housing are adapted to one another in such a way that the inner wall of the receiving sleeve and the outer faces of the housing counteract the housing being pulled out by forming a non-positive connection with each other; and the receiving sleeve has a lateral cutout, through which the housing can be pushed in a direction of an open end of the receiving sleeve counter to the non-positive connection.

24. The dispenser as claimed in claim 23, wherein:

the receiving sleeve and the housing are adapted to one another in such a way that pushing in of the housing is possible only in a rotational position, in which the push button and the cutout are offset in a circumferential direction with respect to one another.

25. The dispenser as claimed in claim 23, wherein:

the receiving sleeve and the housing are adapted to one another in such a way that pushing in of the housing is possible only in a rotational position, in which the push button and the cutout are arranged so as to coincide in a circumferential direction.

* * * * *